US010613469B2

(12) United States Patent
Tanabe et al.

(10) Patent No.: US 10,613,469 B2
(45) **Date of Patent: *Apr. 7, 2020**

(54) DEVELOPING APPARATUS, PROCESS CARTRIDGE, AND IMAGE FORMING APPARATUS

(71) Applicant: CANON KABUSHIKI KAISHA, Tokyo (JP)

(72) Inventors: Masato Tanabe, Susono (JP); Kazutaka Sueshige, Susono (JP); Teruhiko Sasaki, Mishima (JP); Tsukasa Abe, Yokohama (JP); Osamu Anan, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/036,058

(22) Filed: Jul. 16, 2018

(65) Prior Publication Data

US 2018/0321633 A1 Nov. 8, 2018

Related U.S. Application Data

(62) Division of application No. 15/440,030, filed on Feb. 23, 2017, now Pat. No. 10,156,825.

(30) Foreign Application Priority Data

Feb. 29, 2016 (JP) ..... 2016-038460
Mar. 22, 2016 (JP) ..... 2016-057397
(Continued)

(51) Int. Cl.
*G03G 21/16* (2006.01)
*G03G 15/08* (2006.01)
*G03G 21/18* (2006.01)

(52) U.S. Cl.
CPC ..... *G03G 21/1647* (2013.01); *G03G 15/0806* (2013.01); *G03G 21/1676* (2013.01);
(Continued)

(58) Field of Classification Search
CPC .. G03G 21/1647; G03G 21/18; G03G 21/185; G03G 21/1846; G03G 21/1676;
(Continued)

(56) References Cited

U.S. PATENT DOCUMENTS 4,740,767 A 4/1988 Kawano et al.
6,519,431 B1 2/2003 Toba et al.
(Continued)

FOREIGN PATENT DOCUMENTS

CN 101424917 A 5/2009
CN 101551619 A 10/2009
(Continued)

OTHER PUBLICATIONS

Extended European Search Report issued in European Appln. No. 17158071.5, dated Jul. 28, 2017.
(Continued)

*Primary Examiner* — Susan S Lee
(74) *Attorney, Agent, or Firm* — Venable LLP

(57) ABSTRACT

A developing apparatus includes a developer bearing member and a developing frame that rotatably supports the developer bearing member. A one-end side end member is attached to one end of the developing frame in an axis direction of the developer bearing member, with the one-end side end member comprising a one-end side positioned portion to be positioned with respect to an apparatus main body. An other-end side end member is attached to an other end of the developing frame in the axis direction of the developer bearing member, with the other-end side end member comprising an other-end side positioned portion to
(Continued)

be positioned with respect to the apparatus main body. The one-end side end member is rotatable with respect to the developing frame and the other-end side end member, and the other-end side end member is rotatable with respect to the developing frame and the one-end side end member.

34 Claims, 29 Drawing Sheets

(30) Foreign Application Priority Data

Feb. 15, 2017 (JP) ..... 2017-025935
Feb. 15, 2017 (JP) ..... 2017-026341

(52) U.S. Cl.
CPC ..... *G03G 21/18* (2013.01); *G03G 21/185* (2013.01); *G03G 21/1825* (2013.01); *G03G 21/1846* (2013.01); *G03G 2221/1657* (2013.01)

(58) Field of Classification Search
CPC ..... G03G 15/0806; G03G 21/1825; G03G 2221/1657
See application file for complete search history.

(56) References Cited

U.S. PATENT DOCUMENTS

| | | | | |
|---|---|---|---|---|
| 8,774,671 | B2 | 7/2014 | Okabe | |
| 9,026,002 | B2 | 5/2015 | Sato et al. | |
| 10,156,825 | B2 * | 12/2018 | Tanabe | G03G 15/0806 |
| 2001/0055498 | A1 | 12/2001 | Matsuzaki et al. | |
| 2003/0138270 | A1 | 7/2003 | Matsuoka | |
| 2009/0110434 | A1 | 4/2009 | Kusudo et al. | |
| 2009/0245857 | A1 | 10/2009 | Tanabe et al. | |
| 2011/0142491 | A1 | 6/2011 | Numata et al. | |
| 2011/0158703 | A1 | 6/2011 | Sato et al. | |
| 2012/0195612 | A1 | 8/2012 | Kinukawa et al. | |
| 2012/0321342 | A1 * | 12/2012 | Mori | G03G 21/1825 399/111 |
| 2013/0223878 | A1 | 8/2013 | Sato et al. | |
| 2015/0277370 | A1 | 10/2015 | Maeshima et al. | |
| 2015/0309471 | A1 | 10/2015 | Kusudo et al. | |
| 2017/0248869 | A1 * | 8/2017 | Matsumoto | G03G 15/0806 |
| 2017/0248905 | A1 * | 8/2017 | Anan | G03G 15/0865 |
| 2017/0277071 | A1 * | 9/2017 | Abe | G03G 21/1825 |

FOREIGN PATENT DOCUMENTS

| | | | |
|---|---|---|---|
| CN | 202512362 | U | 10/2012 |
| CN | 103620507 | A | 3/2014 |
| CN | 104919377 | A | 9/2015 |
| CN | 104950618 | A | 9/2015 |
| CN | 105022253 | A | 11/2015 |
| EP | 2933690 | A1 | 10/2015 |
| JP | S63-100481 | A | 5/1988 |
| JP | 2001-034146 | A | 2/2001 |
| JP | 2013-020233 | A | 1/2013 |
| JP | 2013-182036 | A | 9/2013 |
| JP | 2013-195541 | A | 9/2013 |
| RU | 2370802 | C2 | 10/2009 |

OTHER PUBLICATIONS

Search Report issued in Russian Appln. No. 2017106227 dated May 8, 2018, partial English translation provided.
Decision on Grant in Russian Patent Application No. 2017106227, dated Sep. 17, 2018 (with English translation).
Examination Report in Philippines Patent Application No. 1/2017/000054, dated Feb. 11, 2019.
Decision on Grant in Russian Patent Application No. 2018140258, dated May 27, 2019 (with English translation).
Jun. 19, 2019 Office Action in Korean Patent Application No. 10-2017-0024654.
Nov. 22, 2019 Communication in European Patent Application No. 17 158 071.5.
Office Action dated Nov. 29, 2019, issued in Chinese Patent Application No. 201710109755.9.
Office Action dated Jan. 28, 2020, in Indian Patent Application No. 201744006440.
Search Report dated Dec. 13, 2018, in Russian Patent Application No. 2019124475 (with English translation).
Decision to Grant dated Jan. 21, 2020, in Russian Patent Application No. 2019124475 (with English translation).

* cited by examiner

DEVELOPING APPARATUS, PROCESS CARTRIDGE, AND IMAGE FORMING APPARATUS

BACKGROUND OF THE INVENTION

Field of the Invention

The present invention relates a developing apparatus that develops an electrostatic latent image formed on a photosensitive drum and is attachable/detachable to/from an apparatus main body of an image forming apparatus, and a process cartridge that forms a developer image on a photosensitive drum and is attachable/detachable to/from an apparatus main body of an image forming apparatus. In addition, the present invention relates to an image forming apparatus that forms an image on a recording medium by using an electrophotographic technology.

Description of the Related Art

Conventionally, image forming apparatuses that form images on recording media such as sheets using an electrophotographic technology have been known. As such, printers (such as laser beam printers and LED printers), copiers, facsimile machines, word processors, multifunction peripherals (multifunction printers), or the like have been, for example, known.

In such an image forming apparatus, a photosensitive drum is uniformly charged by a charging roller. Further, the charged photosensitive drum is selectively exposed to form an electrostatic image on the photosensitive drum. The electrostatic image having been formed on the photosensitive drum is developed as a toner image by a developing apparatus. Further, the toner image having been formed on the photosensitive drum is transferred onto a recording medium such as a recording paper and a plastic sheet. After that, the toner image having been transferred onto a recording material is heated and pressed to be fixed onto the recording medium. In the manner described above, an image is formed on the recording medium.

In such an image forming apparatus, a photosensitive drum, a charging roller, a developing apparatus, and the like are integrated with each other as a cartridge to facilitate the maintenance of parts inside the image forming apparatus. In addition, as a process cartridge, a configuration such as a cleaning cartridge having a photosensitive drum, a developing cartridge serving as a developing apparatus having developing means, a toner cartridge that supplies a developer has been known.

Here, in a technology disclosed in Japanese Patent Application Laid-open No. 2013-182036, a developing cartridge is allowed to be attached/detached to/from the apparatus main body of an image forming apparatus. The developing cartridge has a first frame body that rotatably supports a developing roller and a second frame body that rotatably supports both ends of the first frame body in the longitudinal direction of the developing roller. Further, in a state in which the developing cartridge has been attached to the image forming apparatus, the second frame body of the developing cartridge is positioned and the first frame body thereof is made to be rotatable. Thus, the developing roller is allowed to come in contact with and separate from a photosensitive drum.

However, in the technology disclosed in Japanese Patent Application Laid-open No. 2013-182036, the second frame body that rotatably supports both ends of the first frame body in the longitudinal direction of the developing roller is constituted as one single member. Therefore, in order to provide areas for connecting portions that support both ends of the first frame body with respect to the second frame body, it is necessary to upsize the developing cartridge.

The present invention has an object of preventing the upsize of a developing cartridge serving as a developing apparatus.

SUMMARY OF THE INVENTION

In order to achieve the object described above, a developing apparatus according to the present invention is a developing apparatus comprising:

- a developer bearing member;
- a developing frame body that rotatably supports the developer bearing member;
- a one-end side end member that supports one end of the developing frame body in an axis direction of the developer bearing member; and
- another-end side end member that supports the other end of the developing frame body in the axis direction of the developer bearing member, wherein
- each of the one-end side end member and the other-end side end member is independently rotatable with respect to the developing frame body.

In order to achieve the object described above, a developing apparatus according to the present invention is a developing apparatus comprising:

- a developer bearing member;
- a developing frame body that rotatably supports the developer bearing member;
- an end member that is configured to support one of a one-end side and another-end side of the developing frame body while being configured not to support the other of the one-end side and the other-end side of the developing frame body, and is rotatable with respect to the developing frame body;
- a restricting member that restricts rotation of the end member; and
- a restricted portion capable of engaging with the restricting member, wherein
- the restricting member is movable to a position at which the restricting member engages with the restricted portion to restrict the rotation of the end member and a position at which the restricting member disengages from the restricted portion to allow the rotation of the end member.

In order to achieve the object described above, a process cartridge according to the present invention is a process cartridge comprising:

- the developing apparatus; and
- an image bearing member that comes in contact with and separates from a developer bearing member, wherein
- the process cartridge is configured to form a developer image on the image bearing member by the developing apparatus and configured to be attachable/detachable to/from an apparatus main body of an image forming apparatus.

In order to achieve the object described above, an image forming apparatus according to the present invention is an image forming apparatus comprising:

- the developing apparatus; and
- an image bearing member that comes in contact with and separates from a developer bearing member, wherein the image forming apparatus forms an image on a recording medium using a developer image formed on an image bearing member by the developing apparatus.

In order to achieve the object described above, an image forming apparatus according to the present invention is an image forming apparatus comprising:

the developing apparatus; and a cleaning apparatus that cleans an image bearing member that a developer bearing member comes in contact with and separates from, wherein the developing apparatus and the cleaning apparatus are separately attachable/detachable to/from an apparatus main body of the image forming apparatus.

In order to achieve the object described above, an image forming apparatus according to the present invention is an image forming apparatus comprising:

the developing apparatus; and a photosensitive apparatus having an image bearing member that a developer bearing member comes in contact with and separates from, wherein the developing apparatus and the photosensitive apparatus are separately attachable/detachable to/from an apparatus main body of the image forming apparatus.

Further features of the present invention will become apparent from the following description of exemplary embodiments with reference to the attached drawings.

DESCRIPTION OF THE EMBODIMENTS

Hereinafter, a description will be given, with reference to the drawings, of embodiments of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment (Entire Configuration of Image Forming Apparatus)

Figure 2:
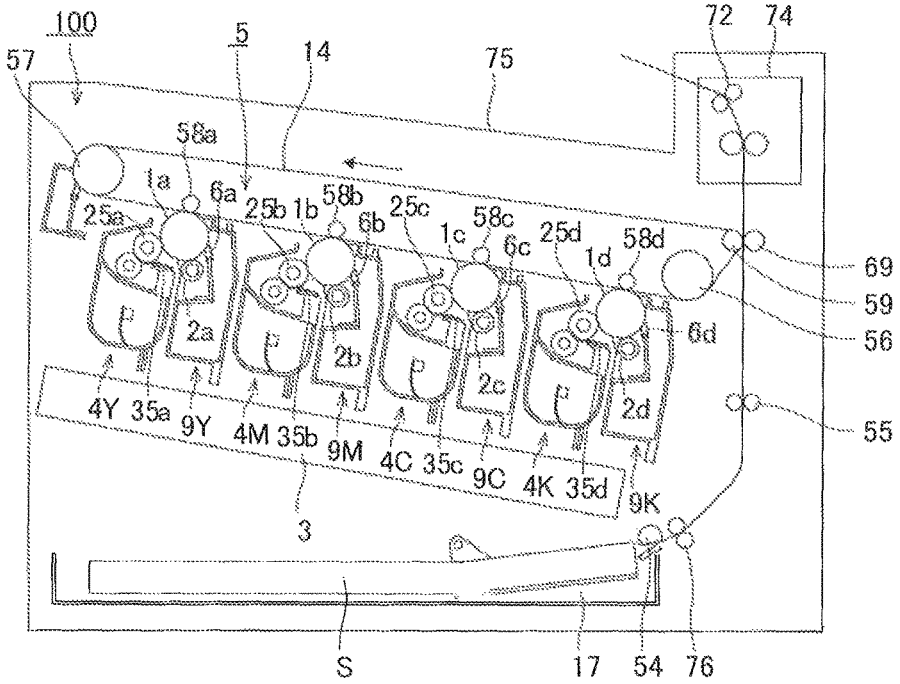
FIG. 2 is a schematic cross-sectional view of an image forming apparatus according to a first embodiment.

First, a description will be given, with reference to FIG. 2, of the entire configuration of an electrophotographic image forming apparatus 100 (hereinafter called an image forming apparatus 100). As shown in FIG. 2, four photosensitive drum cartridges 9 (hereinafter called drum cartridges 9) (9Y to 9K) and four developing apparatuses 4 (hereinafter called developing cartridges 4) (4Y to 4K) are attached to the image forming apparatus 100 by attachment members (not shown). Here, in a direction in which the drum cartridges 9 and the developing cartridges 4 are inserted in the image forming apparatus 100, an upstream side and a downstream side are defined as a near side and a back side, respectively. The developing cartridges according to an embodiment of the present invention are configured to be formed separately from the drum cartridges having respective photosensitive drums and each attachable/detachable to/from the image forming apparatus 100. The developing cartridges will be described in detail later.

In FIG. 2, the drum cartridges 9 and the developing cartridges 4 are provided side by side so as to be inclined with respect to a horizontal direction in the image forming apparatus 100. In addition, in the respective drum cartridges 9, electrophotographic photosensitive drums 1 (hereinafter called photosensitive drums 1) (1*a*, 1*b*, 1*c*, and 1*d*) serving as image bearing members and charging rollers 2 (2*a*, 2*b*, 2*c*, and 2*d*) serving as charging members arranged around the photosensitive drums 1 are provided. In addition, in the respective drum cartridges 9, process means such as cleaning members 6 (6*a*, 6*b*, 6*c*, and 6*d*) is provided. Here, in the respective drum cartridges 9, the photosensitive drums 1, the charging rollers 2, the process means such as the cleaning members 6 are integrally configured.

In addition, in the respective developing cartridges 4 (4Y to 4K), developing rollers 25 (25*a* to 25*d*) serving as developer bearing members and process means such as developing blades 35 (35*a* to 35*d*) serving as developer restricting members are integrally provided. The charging rollers 2 uniformly charge the surfaces of the photosensitive drums 1, and the developing rollers 25 develop latent images (electrostatic latent images) formed on the photosensitive drums 1 with developers (hereinafter called toner). That is, the developing rollers 25 bear the toner serving as developers for developing the electrostatic latent images formed on the photosensitive drums 1. Further, the cleaning members 6 remove the toner serving as developers remaining on the photosensitive drums 1 after toner images serving as developer images formed on the photosensitive drums 1 are transferred onto a recording medium S.

In addition, under the drum cartridges 9 and the developing cartridges 4, a scanner unit 3 serving as an exposure apparatus that selectively exposes the photosensitive drums 1 based on image information to form electrostatic latent images on the photosensitive drums 1 is provided. Further, at the lower part of the image forming apparatus 100, a cassette 17 in which the recording medium S is accommodated is attached. Further, recording medium transport means that transports the recording medium S is provided to transport the recording medium S to the upper part of the image forming apparatus 100 via a secondary transfer roller 69 and a fixing unit 74. Specifically, as recording medium transport means, a feeding roller 54 that separately feeds one at a time the recording medium S in the cassette 17 and a pair of transport rollers 76 that transports the fed recording medium S are provided. In addition, as recording medium transport means, a pair of resist rollers 55 that synchronizes electrostatic latent images formed on the photosensitive drums 1 with the recording medium S is provided.

In addition, over the drum cartridges 9 and the developing cartridges 4, an intermediate transfer unit 5 that transfers toner images formed on the photosensitive drums 1 (1*a*, 1*b*, 1*c*, and 1*d*) is provided as intermediate transfer means. The intermediate transfer unit 5 has a driver roller 56, a driven roller 57, primary transfer rollers 58 (58*a*, 58*b*, 58*c*, and 58*d*) arranged at positions facing the photosensitive drums 1 of the respective colors, and a facing roller 59 arranged at a position facing the secondary transfer roller 69. In addition, a transfer belt 14 serving as an intermediate transfer member is stretched over between the driver roller 56, the driven roller 57, the primary transfer rollers 58, and the secondary transfer roller 69. Further, the transfer belt 14 circularly moves while facing and contacting all the photosensitive drums 1. Further, when a voltage is applied to the primary transfer rollers 58 (58*a*, 58*b*, 58*c*, and 58*d*), toner images serving as developer images are primarily transferred from the photosensitive drums 1 onto the transfer belt 14.

As described above, the respective photosensitive drums 1 are uniformly charged by the charging rollers 2 while rotating, and further selectively exposed by the scanner unit 3. Thus, electrostatic latent images are formed on the photosensitive drums 1. The electrostatic latent images are developed by the developing rollers 25. As a result, toner images of the respective colors are formed on the respective photosensitive drums 1. Further, in synchronization with the formation of such toner images, the pair of resist rollers 55 transports the recording medium S to a secondary transfer position at which the facing roller 59 and the secondary transfer roller 69 come in contact with each other via the transfer belt 14.

Further, when a transfer bias voltage is applied to the secondary transfer roller 69, toner images of the respective colors on the transfer belt 14 are secondarily transferred onto the recording medium S. The recording medium S onto which the toner images serving as color developer images have been transferred is heated and pressed by the fixing unit 74. Thus, the toner images are fixed onto the recording medium S. After that, the recording medium S is discharged onto a discharge unit 75 by a discharge roller 72. Note that the fixing unit 74 is arranged at the upper part of the image forming apparatus 100.

(Configuration of Drum Cartridge)

Figure 3:
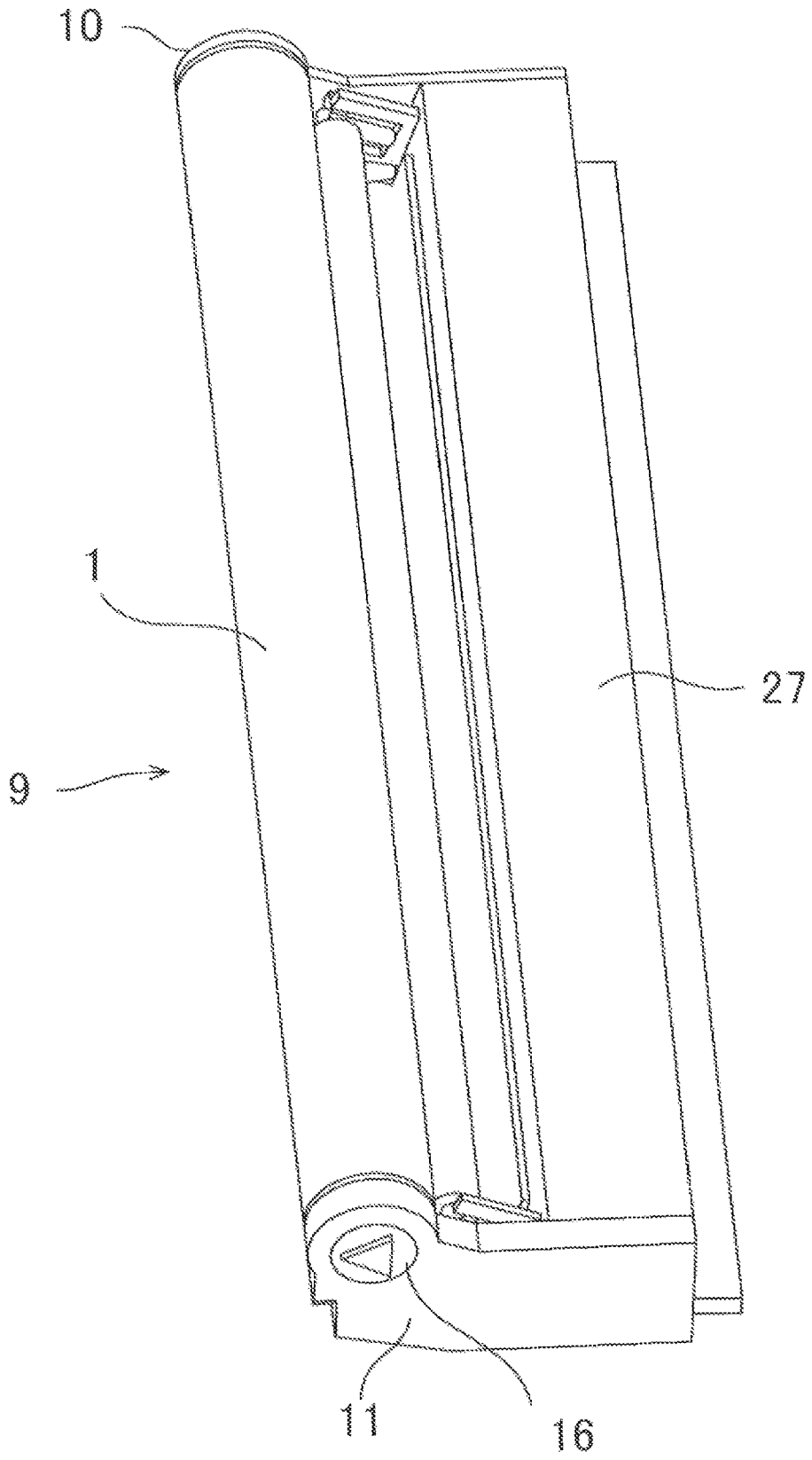
FIG. 3 is an external perspective view of a drum cartridge according to the first embodiment.
Figure 4:
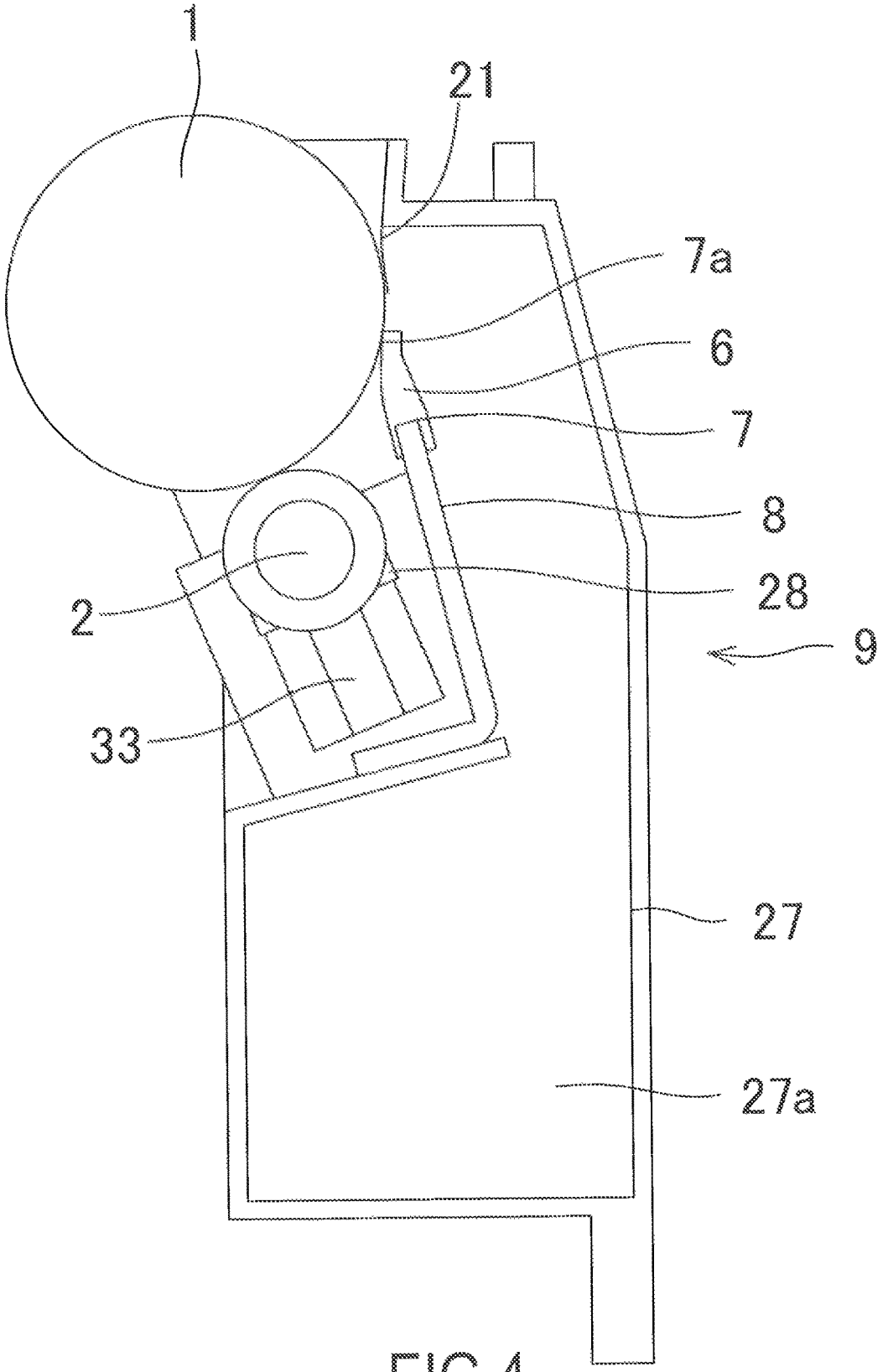
FIG. 4 is a schematic cross-sectional view of the drum cartridge according to the first embodiment.

Next, a description will be given, with reference to FIGS. 3 and 4, of the drum cartridge 9 according to the embodiment. FIG. 3 is an external perspective view of the drum cartridge 9 (9Y, 9M, 9C, 9K). Note that the drum cartridges 9Y to 9K have the same configuration. In the embodiment, in the direction in which the drum cartridge 9 and the developing cartridge 4 are inserted, the upstream side and the downstream side are defined as the near side and the back side, respectively, as described above. In addition, FIG. 4 is a schematic cross-sectional view of the drum cartridge 9.

With respect to a cleaning frame body 27 of the drum cartridge 9 (9Y, 9M, 9C, 9K), the photosensitive drum 1 is rotatably supported by a drum front bearing 10 and a drum back bearing 11. In addition, on one end side in the rotation axis direction of the photosensitive drum 1, a drum coupling 16 and a flange (not shown) are provided. As described above, the charging roller 2 and the cleaning member 6 are provided around the photosensitive drum 1.

The cleaning member 6 is constituted by a rubber blade 7 and a cleaning support member 8. A tip end portion 7*a* of the rubber blade 7 is arranged so as to come in contact with the photosensitive drum 1 in a direction countering the rotating direction of the photosensitive drum 1. Further, remaining toner removed from the surface of the photosensitive drum 1 by the cleaning member 6 drops into a removed toner chamber 27*a*. In addition, a squeegee sheet 21 that prevents the leakage of the toner from the removed toner chamber 27*a* comes in contact with the photosensitive drum 1. Further, when a drive force is transmitted from a main-body drive motor (not shown) to the drum cartridge 9, the photosensitive drum 1 rotates and drives according to an image forming operation. In addition, the charging roller 2 is rotatably attached to the drum cartridge 9 via a charging roller bearing 28, and pressed toward the photosensitive drum 1 by a charging roller press member 33. The charging roller 2 rotates so as to follow the photosensitive drum 1.

(Configuration of Developing Cartridge)

Figure 5:
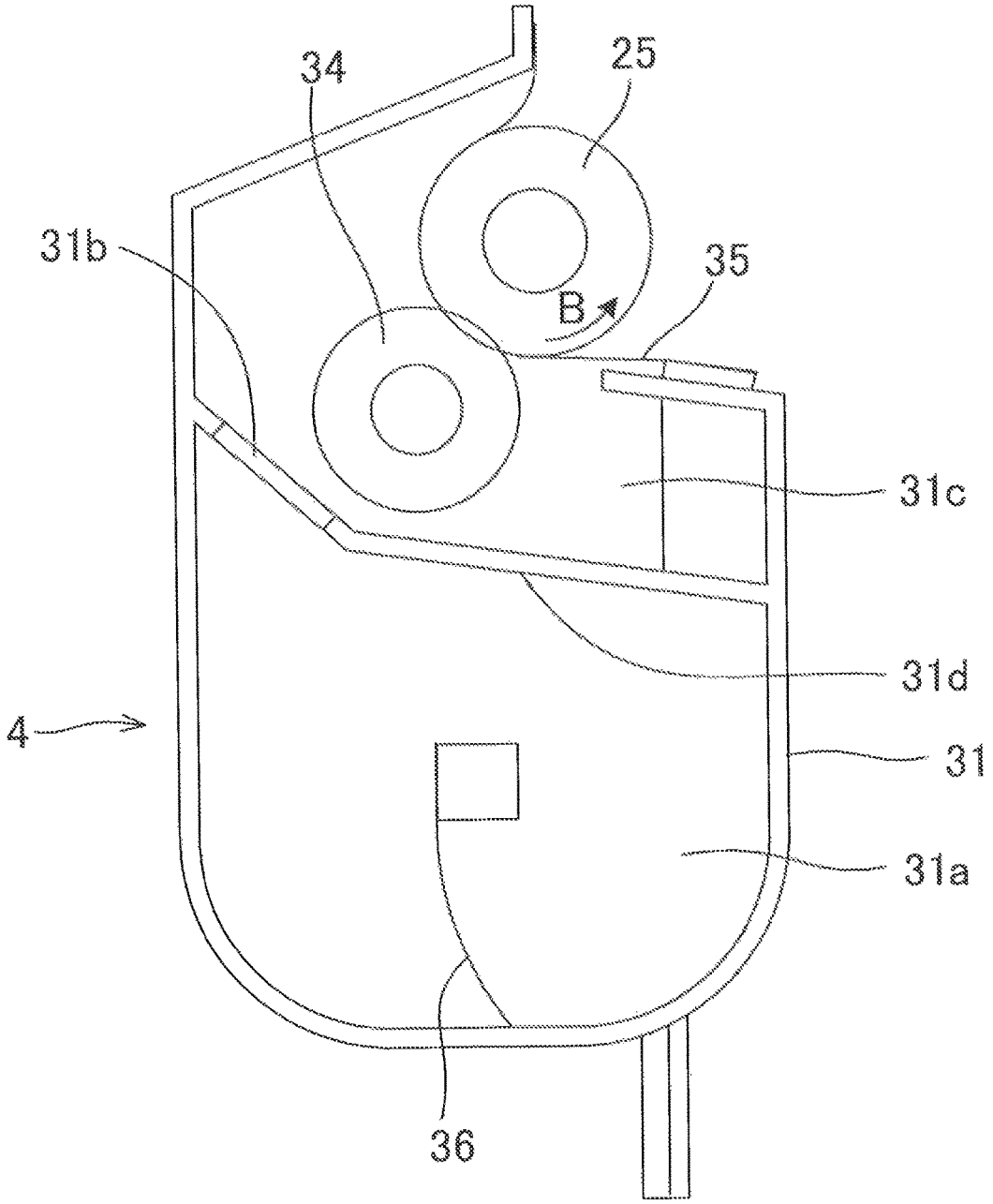
FIG. 5 is a schematic cross-sectional view of a developing cartridge according to the first embodiment.
Figure 7:
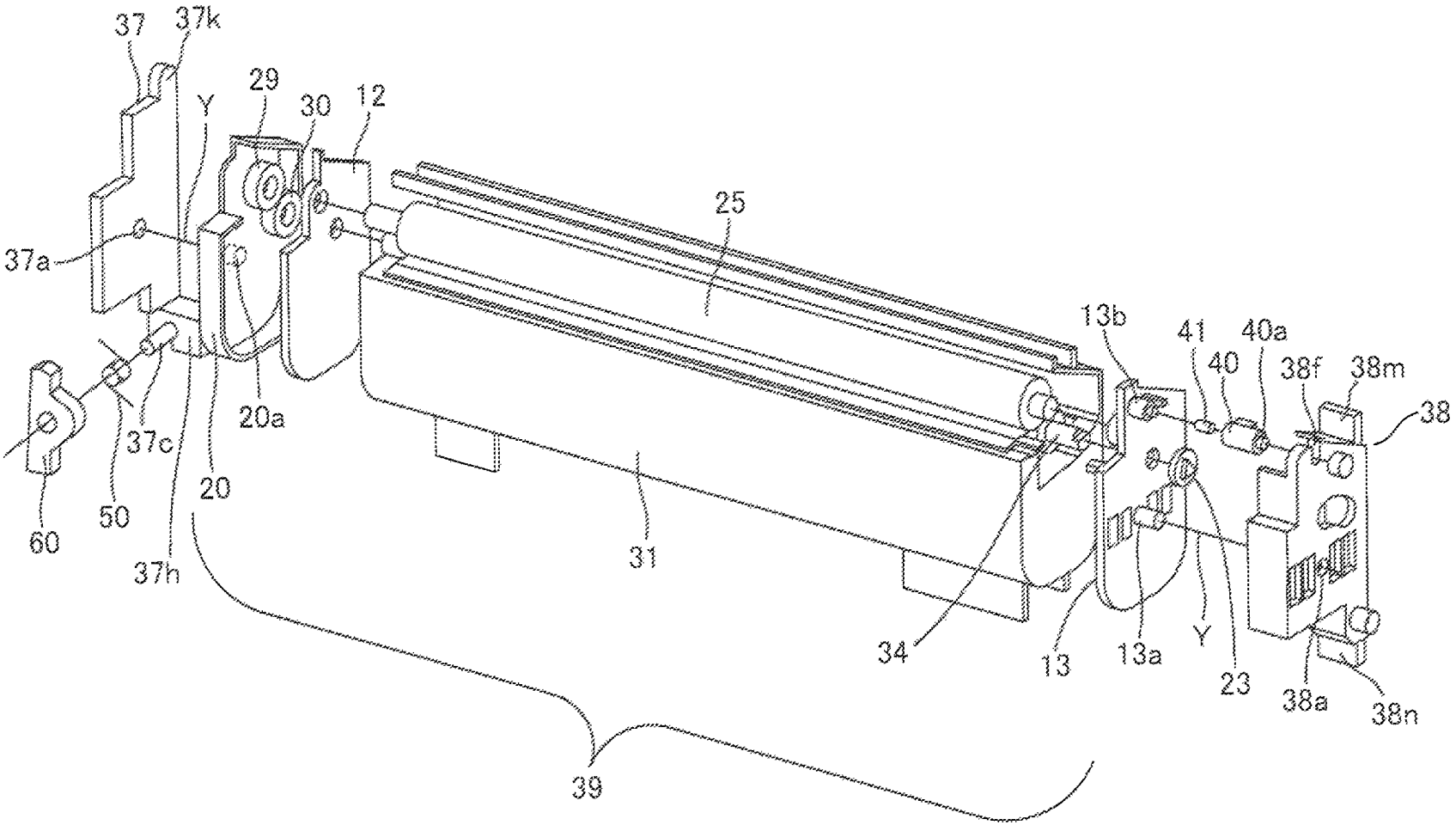
FIG. 7 is an exploded perspective view of the developing cartridge according to the first embodiment.

Next, a description will be given, with reference to FIGS. 5 and 7, of the configuration of the developing cartridge 4 serving as a developing apparatus. FIG. 5 is a schematic cross-sectional view of the developing cartridge 4 (4Y, 4M, 4C, 4K) serving as a developing apparatus. In addition, FIG. 7 is an exploded perspective view of the developing cartridge 4. Note that in the embodiment, the developing cartridge 4Y in which the toner, as a developer, of yellow is accommodated, the developing cartridge 4M in which the toner of magenta is accommodated, and the developing cartridge 4C in which the toner of cyan is accommodated have the same configuration. Further, the developing cartridge 4K in which the toner of black is accommodated has also the same configuration.

Here, the developing cartridge 4 serving as a developing apparatus has a developing roller 25 that rotates in an arrow B direction while contacting the photosensitive drum 1, and a toner supply roller 34 serving as a supply member that rotates while contacting the developing roller 25. In addition, the developing cartridge 4 has a developing blade 35 that controls or restricts toner (the thickness of a toner layer) on the developing roller 25 and a toner transport member 36. Here, the developing apparatus is an apparatus that develops an electrostatic latent image formed on the photosensitive drum with a developer, and constituted by developing means, a developing frame body supporting the developing means, components related to the developing means, or the like. Further, examples of the developing means include a developing roller, a coating roller, and a developing blade. In addition, the developing cartridge 4 serving as a developing apparatus has a developing frame body 31 that supports the developing roller 25, the toner supply roller 34, the developing blade 35, and the toner transport member 36.

The developing frame body 31 has a developing chamber 31*c* in which the developing roller 25 is arranged, and a toner accommodation chamber 31*a* provided beneath the developing chamber 31*c*. Further, the toner accommodation chamber 31*a* and the developing chamber 31*c* are partitioned by a partition wall 31*d*. In addition, the partition wall 31*d* is provided with an opening portion 31*b* via which the toner accommodation chamber 31*a* and the developing chamber 31*c* communicate with each other. Further, as described above, the toner accommodation chamber 31*a* of the developing frame body 31 is provided with the toner transport member 36 that transports the toner to the developing chamber 31*c* via the opening portion 31*b* while stirring the toner serving as an accommodated developer.

As shown in FIG. 7, the developing roller 25 and the toner supply roller 34 are rotatably supported by a front-side developing bearing 12 and a back-side developing bearing 13 on both end sides in the axis direction of the developing roller 25. That is, the front-side developing bearing 12 and the back-side developing bearing 13 are bearings serving as parts of a pivotally-supported member or the developing frame body 31. In addition, a developing coupling 23 (drive receiving portion) is provided at the back-side end of the toner supply roller 34. In addition, a toner supply gear 30 is provided at the near-side end of the toner supply roller 34. A developing gear 29 that meshes with the toner supply gear 30 is provided at the near-side end of the developing roller 25. Therefore, when a drive force is transmitted from the main-body drive motor (not shown) to the developing coupling 23, the toner supply roller 34 and the developing roller 25 rotate and drive according to an image forming operation.

In addition, a gear cover 20 is provided outside the developing gear 29 and the toner supply gear 30. That is, the gear cover 20 is a gear cover serving as a part of the developing frame body 31. Here, it is assumed that the configuration of the developing frame body 31 described above represents a developing unit 39. A front-side end member 37 (corresponding to a one-end side end member or a first end member) and a back-side end member 38 (corresponding to the other-end side end member or a second end member) are provided at one end and the other end in the axis direction of the developing roller 25 of the developing frame body 31, respectively. That is, the near-end side end member 37 is provided on a one-end side of both ends of the developing unit 39 in the axis direction of the developing roller 25. In addition, the back-side end member 38 is provided on the other-end side of both ends of the developing unit 39 in the axis direction of the developing roller 25. The back-side end member 38 is provided with a hook hole 38*a* (corresponding to the other-end side engaged portion) serving as a back-side supported hole engaging with a boss 13*a* (corresponding to the other-end side engaging portion) serving as a back-side support shaft provided on the back-side developing bearing 13. In addition, the front-side end member 37 is provided with a hook hole 37*a* (corresponding to a one-end side engaged portion) serving as a near-side supported hole engaging with a boss 20*a* (corresponding to a one-end side engaging portion) serving as a near-side support shaft provided on the gear cover 20. Note that the boss 20*a* is provided so as to protrude from the gear cover 20 in the direction of the front-side end member 37. The front-side end member 37 and the back-side end member 38 are rotatably attached with respect to an axis Y (corresponding to a rotation axis) connecting the boss 13*a* of the back-side developing bearing 13 and the boss 20*a* of the gear cover 20 to each other. That is, the front-side end member 37 and the back-side end member 38 are rotatably attached about the rotation axis Y (corresponding to a first rotation axis) passing through the boss 13*a* of the back-side developing bearing 13 and the boss 20*a* of the gear cover 20. The rotation axis Y extends in the axis direction of the developing roller 25. The rotation axis Y is preferably parallel to the axis direction of the developing roller 25. In addition, since the boss 13*a* and the boss 20*a* are concentric with each other in the embodiment, the rotation axis Y is consistent on both the back side and the near side. Accordingly, the developing unit 39 is made to be rotatable about the one rotation axis Y connecting the boss 13*a* and the boss 20*a* to each other. In addition, the front-side end member 37 is configured to rotatably support the one-end side in the axis direction of the developing roller 25 of the developing unit 39, while being configured not to support the other-end side in the axis direction of the developing roller 25 of the developing unit 39. The back-side end member 38 is configured to rotatably support the other-end side in the axis direction of the developing roller 25 of the developing unit 39, while being configured not to support the one-end side in the axis direction of the developing roller 25 of the developing unit 39. That is, the front-side end member 37 and the back-side end member 38 are configured to support in the axis direction of the developing roller 25 one of the one-end side and the other-end side of the developing frame body 31 while being configured not to support the other of the one-end side and the other-end side of the developing frame body 31. In addition, in the embodiment, the front-side end member 37 and the back-side end member 38 are each independently rotatable with respect to the developing frame body 31. That is, as shown in FIG. 7, the front-side end member 37 is rotatable with respect to the developing frame body 31 and the back-side end member 38. The back-side end member 38 is rotatable with respect to the developing frame body 31 and the front-side end member 37. In other words, when the front-side end member 37 rotates with respect to the developing frame body 31, the back-side end member 38 is allowed to stop with respect to the developing frame body 31 and the front-side end member 37. In addition, when the back-side end member 38 rotates with respect to the developing frame body 31, the front-side end member 37 is allowed to stop with respect to the developing frame body 31 and the back-side end member 38. Note that in the embodiment, the developing frame body 31 takes a plurality of positions with respect to the front-side end member 37. Further, one of the plurality of positions is a developing position at which an image is formed on the recording medium S with the toner.

(Configuration of Attaching/Detaching Drum Cartridges 9 and Developing Cartridges 4)

Figure 6:
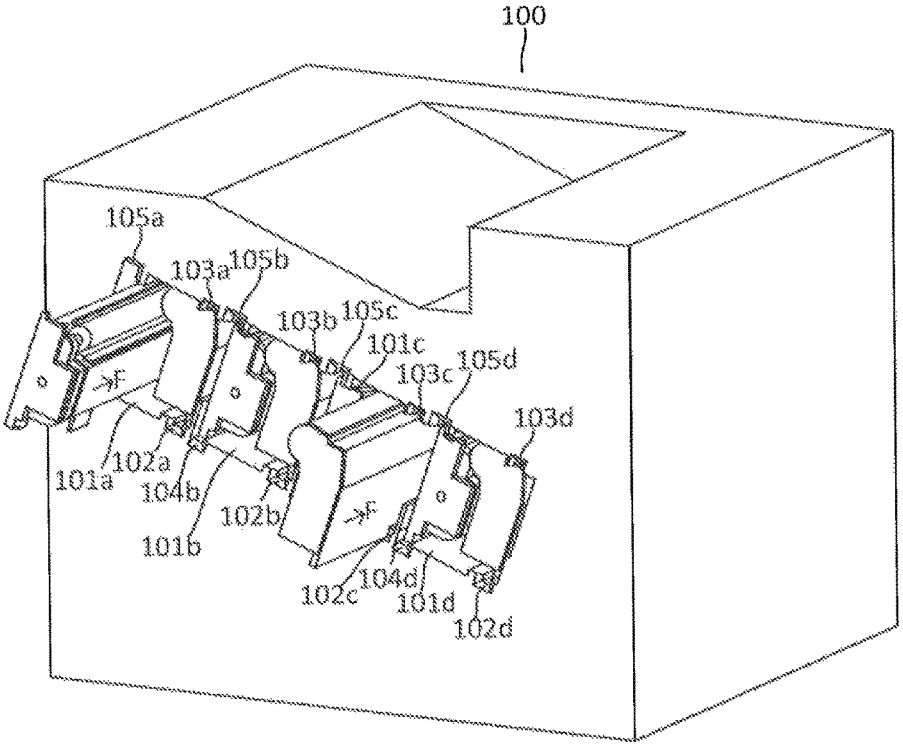
FIG. 6 is a view showing the operation of attaching the developing cartridge according to the first embodiment to the image forming apparatus.

Next, a description will be given, with reference to FIG. 6, of the configuration of attaching the drum cartridges 9 and the developing cartridges 4 to the apparatus main body of the image forming apparatus 100. Note that in the embodiment, the drum cartridges 9 (9Y, 9M, 9C, 9K) and the developing cartridges 4 (4Y, 4M, 4C, 4K) are inserted in opening portions 101 (101*a*, 101*b*, 101*c*, 101*d*) of the image forming apparatus 100. Here, in the embodiment, the drum cartridges 9 are inserted in an arrow F direction in FIG. 6 from the near side to the back side in the axis direction of (preferably in a direction parallel to) the photosensitive drums 1. In addition, in the embodiment, a direction in which the developing cartridges 4 are inserted in the opening portions 101 (101*a*, 101*b*, 101*c*, and 101*d*) of the apparatus main body 100 is the direction (arrow F direction) parallel to the axis direction of the photosensitive drums 1. In other words, in the axis direction of (preferably in the direction parallel to) the developing rollers 25, the developing cartridges 4 are inserted in the arrow F direction in FIG. 6 from the near side to the back side. In addition, in the embodiment, in the direction in which the drum cartridges 9 and the developing cartridges 4 are inserted, the upstream side and the downstream side are defined as the near side and the back side, respectively, as described above.

On the upper side of the image forming apparatus 100, main-body attachment upper guide portions 103 (103*a*, 103*b*, 103*c*, and 103*d*) are provided. On the lower side of the image forming apparatus 100, main-body attachment lower guide portions 102 (102*a*, 102*b*, 102*c*, and 102*d*) are provided. Each of the main-body attachment upper guide portions 103 and the main-body attachment lower guide portions 102 has a shape extending along the arrow F direction of the drum cartridges 9 (in the axis direction of the photosensitive drums 1). Further, in a state of being fitted with the main-body attachment lower guide portions 102 on the near side in the arrow F direction, the drum cartridges 9 are moved in the arrow F direction along the main-body attachment upper guide portions 103 and the main-body attachment lower guide portions 102. In the manner described above, the drum cartridges 9 are inserted in the image forming apparatus 100.

In addition, main-body attachment upper guide portions 105 (corresponding to first guide portions) and main-body attachment lower guide portions 104 (corresponding to second guide portions) are provided on an upper side and a lower side in the apparatus main body, respectively. Each of the main-body attachment upper guide portions 105 and the main-body attachment lower guide portions 104 has a guide shape extending along the F direction indicated by an arrow in which the developing cartridges 4 are inserted. The developing cartridges 4 serving as developing apparatuses are inserted in the image forming apparatus 100 in the same manner as when the drum cartridges 9 are inserted in the image forming apparatus 100. That is, on the near side in the arrow F direction (in the axis direction of the developing rollers 25), the developing cartridges 4 are fitted with the main-body attachment upper guide portions 105 provided on the upper side of the image forming apparatus 100 and the main-body attachment lower guide portions 104 provided on the lower side of the image forming apparatus 100. Further, the developing cartridges 4 are moved along the main-body attachment upper guide portions 105 and the main-body attachment lower guide portions 104 toward the arrow F direction.

Specifically, as shown in FIG. 7, the front-side end member 37 is provided with a guided portion 37*k* (corresponding also to a one-end side guided portion) serving as a third guided portion to be guided by the main-body attachment upper guide portion 105 serving as a first guide portion provided in the apparatus main body of the image forming apparatus 100. In addition, the front-side end member 37 is provided with a guided portion 37*h* (corresponding also to a one-end side guided portion) serving as a fourth guided portion to be guided by the main-body attachment lower guide portion 104 serving as a second guide portion provided in the apparatus main body of the image forming apparatus 100. On the other hand, the back-side end member 38 is provided with a guided portion 38*m* (corresponding also to the other-end side guided portion) serving as a first guided portion to be guided by the main-body attachment upper guide portion 105 serving as a first guide portion. In addition, the back-side end member 38 is provided with a guided portion 38*n* (corresponding also to the other-end side guided portion) serving as a second guided portion to be guided by the main-body attachment lower guide portion 104 serving as a second guide portion. Further, the guided portions 37*k* and 38*m* are to be guided by the main-body attachment upper guide portion 105, and the guided portions 37*h* and 38*n* are to be guided by the main-body attachment lower guide portion 104. Thus, at the insertion of the developing cartridge 4, the developing cartridge 4 is inserted with respect to the apparatus main body of the image forming apparatus 100. As shown in FIG. 7, in the embodiment, the developing cartridge 4 is inserted with the back-side end member 38 oriented to the downstream side in the inserting direction. That is, in the inserting direction, the back-side end member 38 is arranged on the downstream side of the front-side end member 37. In other words, the back-side end member 38 is arranged on the downstream side in the inserting direction with respect to the developing frame body 31, and the front-side end member 37 is arranged on the upstream side in the inserting direction with respect to the developing frame body 31.

(Configuration of Back-Side End Member 38)

Figure 8:
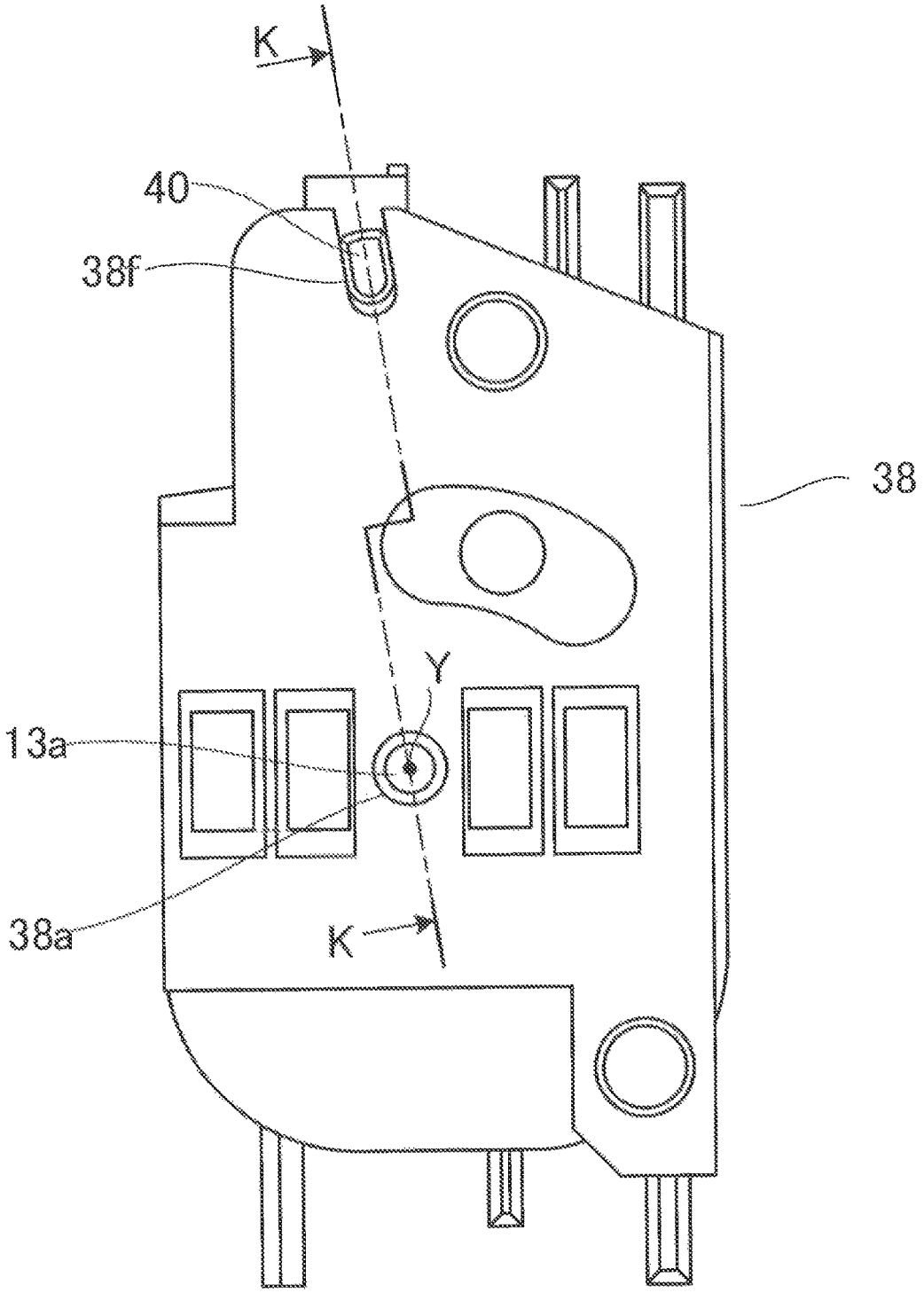
FIG. 8 is an external view of the developing cartridge when seen from the side of a back-side end member according to the first embodiment.
Figure 9A:
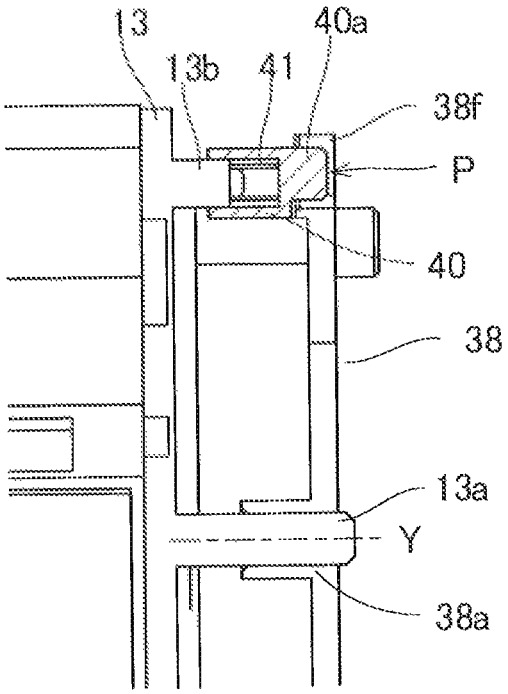
FIGS. 9A and 9B are cross-sectional views of the developing cartridge on the side of the back-side end member according to the first embodiment.
Figure 9B:
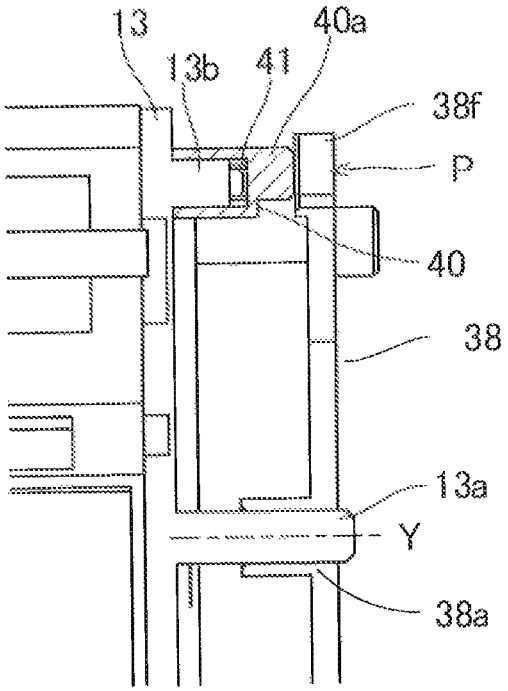

Next, a description will be given, with reference to FIG. 7 to FIGS. 9A and 9B, of the configuration of the back-side end member 38. FIG. 8 is an external view of the developing cartridge 4 when seen from the side of the back-side end member 38. In addition, FIGS. 9A and 9B are cross-sectional views (cross-sectional views taken along line K-K in FIG. 8) of the developing cartridge 4 on the side of the back-side end member 38. As shown in FIG. 7, the back-side developing bearing 13 is provided with a back-side restricting member 40 (corresponding to a restricting member or the other-end side restricting member) that controls or restricts the rotation of the back-side end member 38 with respect to the back-side developing bearing 13. The back-side restricting member 40 is a protruding portion extending in a direction in which the developing cartridge 4 is attached to the image forming apparatus 100 in a posture in which the developing cartridge 4 is attached/detached to/from the image forming apparatus 100. In addition, the back-side restricting member 40 is movable in the direction in which the developing cartridge 4 serving as a developing apparatus is attached/detached to/from the image forming apparatus 100.

In addition, as shown in FIGS. 9A and 9B, a control spring 41 (corresponding to the other-end side urging member) serving as an urging member is attached to a spring support portion 13*b* of the back-side developing bearing 13 inside the back-side restricting member 40. The control spring 41 serving as an urging member presses the back-side restricting member 40 in the direction in which the developing cartridge 4 is attached to the image forming apparatus 100 in the posture in which the developing cartridge 4 is attached/detached to/from the image forming apparatus 100. In addition, the control spring 41 urges the back-side restricting member 40 in a direction in which the back-side restricting member 40 and a groove portion 38*f* (corresponding to a restricted portion or the other-side restricted portion) engage with each other. On the other hand, the back-side end member 38 is provided with the groove portion 38*f* capable of engaging with the restricting portion 40*a* of the back-side restricting member 40. The groove portion 38*f* penetrates in the direction in which the developing cartridge 4 is attached/detached to/from the image forming apparatus 100. In addition, as described above, the back-side developing bearing 13 is provided with the boss 13*a*, and the back-side end member 38 is provided with the hook hole 38*a* capable of engaging with the boss 13*a*.

Here, in a state in which the developing cartridge 4 has not been attached to the image forming apparatus 100, the hook hole 38*a* and the boss 13*a* engage with each other and the restricting portion 40*a* and the groove portion 38*f* engage with each other (see FIG. 8 and FIG. 9A). When the restricting portion 40*a* and the groove portion 38*f* engage with each other like this, the back-side end member 38 is not allowed to rotate about the boss 13*a* of the back-side developing bearing 13. That is, when the back-side restricting member 40 fits into the groove portion 38*f*, the back-side developing bearing 13 is positioned with respect to the back-side end member 38.

Figure 22:
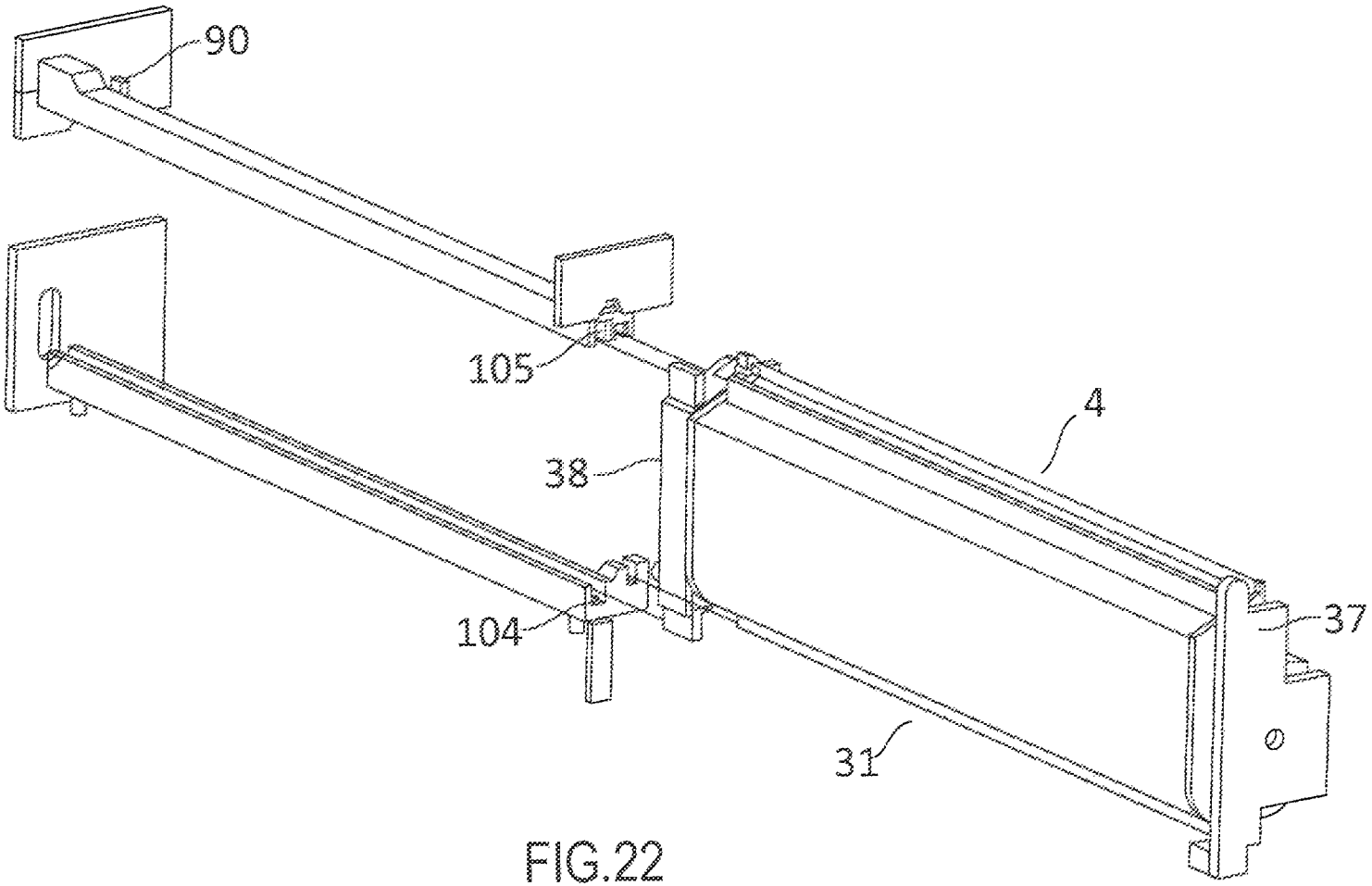
FIG. 22 is a view showing a state in which the developing cartridge is being attached to the image forming apparatus.

On the other hand, when the back-side restricting member 40 is pressed in a P direction in FIGS. 9A and 9B in a state in which the restricting portion 40*a* and the groove portion 38*f* have engaged with each other, the back-side restricting member 40 moves in the P direction against the pressing force of the control spring 41. Here, the P direction is a direction opposite to the direction in which the developing cartridge 4 is inserted in the apparatus main body of the image forming apparatus 100. Thus, the engagement between the restricting portion 40*a* of the back-side restricting member 40 and the groove portion 38*f* of the back-side end member 38 is cancelled (see FIG. 9B). In this state, the developing frame body 31 is made to be freely rotatable with respect to the back-side end member 38 about the boss 13*a* of the back-side developing bearing 13. Here, FIG. 22 is a view showing a state in which the developing cartridge 4 is being attached to the apparatus main body of the image forming apparatus 100. In the embodiment, the back-side restricting member 40 is pressed in the P direction by an engagement cancelling portion 90 provided on the apparatus main body of the image forming apparatus 100.

That is, in a state before the developing cartridge 4 has been attached to the image forming apparatus 100 and a state in which the back-side restricting member 40 has not been pressed by the engagement cancelling portion 90 provided on the apparatus main body of the image forming apparatus 100, the back-side restricting member 40 and the groove portion 38*f* engage with each other. Therefore, the back-side developing bearing 13 is positioned with respect to the back-side end member 38. However, when the back-side restricting member 40 is pressed by the engagement cancelling portion 90 in conjunction with the attachment operation of the developing cartridge 4 to the image forming apparatus 100 and the engagement between the back-side restricting member 40 and the groove 38*f* is cancelled, the back-side developing bearing 13 is made to be rotatable with respect to the back-side end member 38. Here, the engagement between the back-side restricting member 40 and the groove portion 38*f* is cancelled when the back-side restricting member 40 is pressed by the engagement cancelling portion 90 in a direction in which the developing cartridge 4 is removed from the image forming apparatus 100. At this time, the back-side restricting member 40 does not overlap with the groove portion 38*f* when seen from a direction orthogonal to the rotation axis Y of the developing unit 39. Thus, the developing unit 39 is made to be rotatable with respect to the back-side end member 38. Note that the rotation axis Y of the back-side developing bearing 13 is oriented in the direction in which the developing cartridge 4 is attached/detached to/from the image forming apparatus 100 (preferably in the direction parallel to the image forming apparatus 100) in the posture in which the developing cartridge 4 is attached/detached to/from the image forming apparatus 100.

As described above, in the embodiment, since the restricting portion 40*a* and the groove portion 38*f* engage with each other in a state in which the developing cartridge 4 has not been attached to the image forming apparatus 100, the back-side developing bearing 13 is not allowed to rotate with respect to the back-side end member 38. On the other hand, since the engagement between the restricting portion 40*a* and the groove portion 38*f* is cancelled in a state in which the developing cartridge 4 has been attached to the image forming apparatus 100, the back-side developing bearing 13 is allowed to rotate with respect to the back-side end member 38. Here, the restricting portion 40*a* of the back-side restricting member 40 is pressed by the engagement cancelling portion 90 provided on the apparatus main body of the image forming apparatus 100 in conjunction with the inserting operation of the developing cartridge 4 in the image forming apparatus 100. Thus, the engagement between the restricting portion 40*a* and the groove portion 38*f* is cancelled.

(Configuration of Front-Side End Member)

Figure 1A:
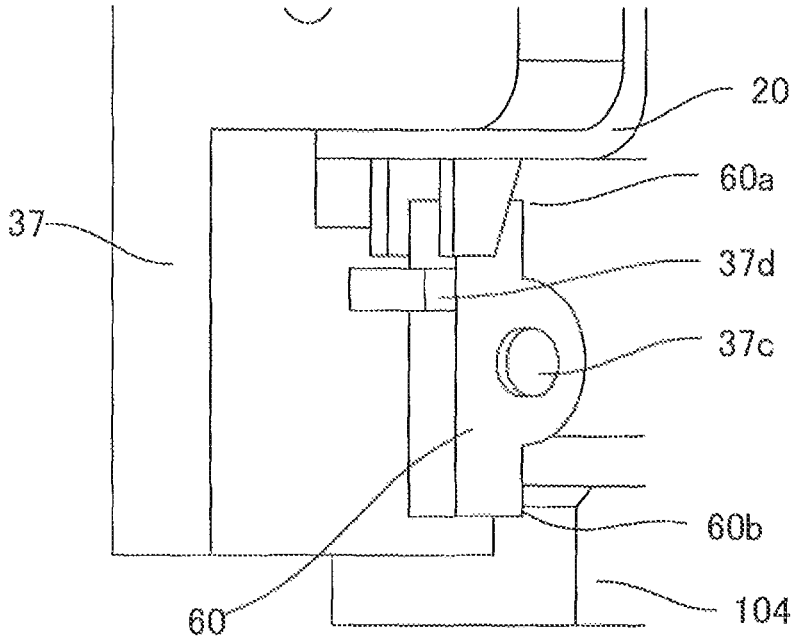
FIGS. 1A and 1B are views for describing the configurations of a front-side end member and a near-side restricting member.
Figure 1B:
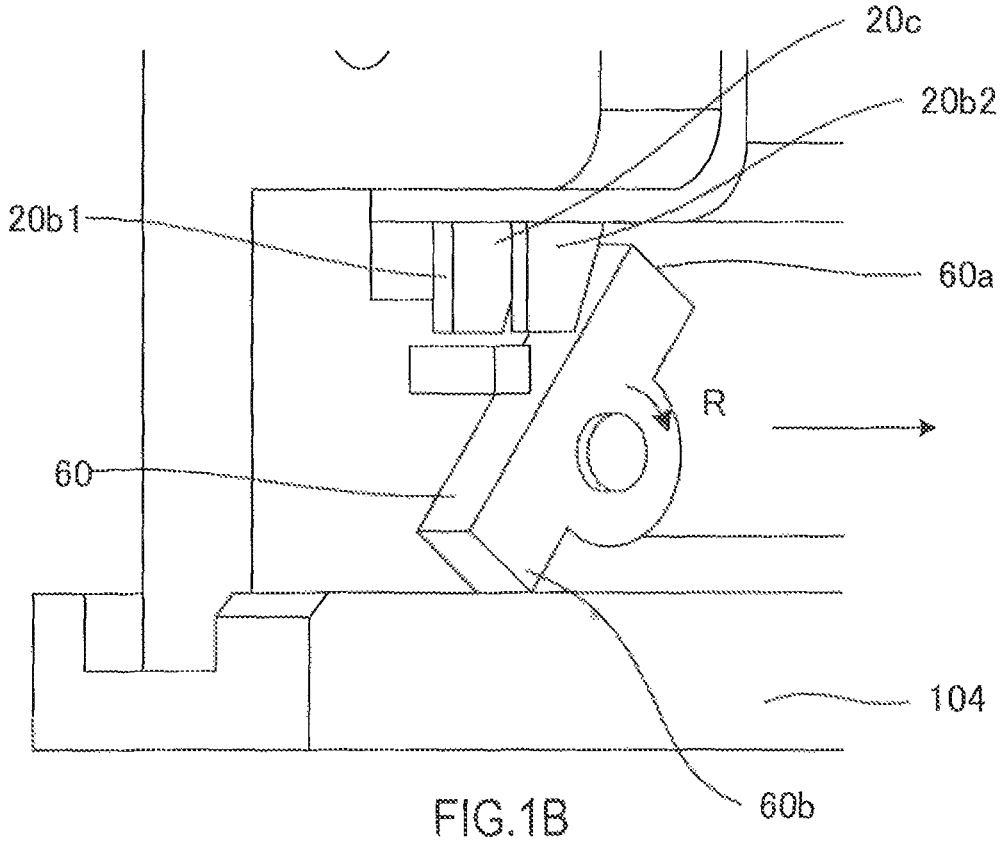
Figure 10:
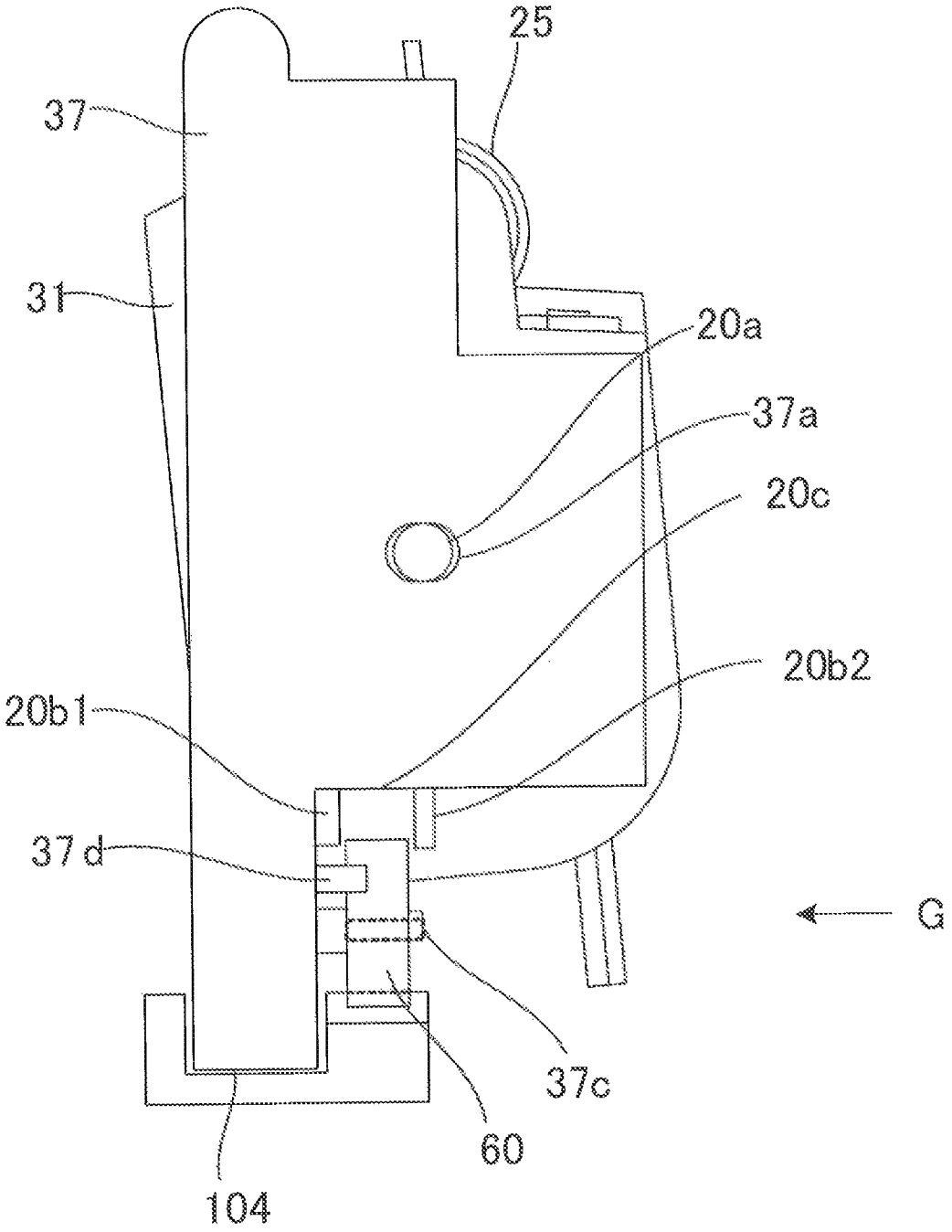
FIG. 10 is a view showing the developing cartridge in a state of being attached to the image forming apparatus according to the first embodiment.

Next, a description will be given, with reference to FIGS. 1A and 1B, FIG. 7, and FIG. 10, of the configuration of the front-side end member 37. FIGS. 1A and 1B are views for describing the configurations of the front-side end member 37 and a near-side restricting member 60. FIG. 10 is a view showing the developing cartridge 4 in a state in which the developing cartridge 4 has been attached to the image forming apparatus 100. FIGS. 1A and 1B are views of the developing cartridge 4 shown in FIG. 10 when seen from a G direction. FIG. 1A is a view showing a state in which the developing cartridge 4 is being attached to the image forming apparatus 100, and FIG. 1B is a view showing a state in which the attachment of the developing cartridge 4 to the image forming apparatus 100 has been completed.

As shown in FIG. 7, in the embodiment, the near-side restricting member 60 is rotatably attached to a boss 37*c* of the front-side end member 37 to prevent the front-side end member 37 from rotating with respect to the front-side developing bearing 12 and the gear cover 20. The near-side restricting member 60 corresponds to a restricting member or a one-end side restricting member. Here, the boss 37*c* (the extending direction of the boss 37*c* corresponds to a second rotation axis) extends in a direction crossing (preferably in a direction orthogonal to) the axis direction of the developing roller 25. Further, the near-side restricting member 60 is rotatably supported with the boss 37*c* as a central axis. The boss 37*c* extends in a direction crossing the direction in which the developing cartridge 4 is inserted in the apparatus main body of the image forming apparatus 100. That is, the near-side restricting member 60 is rotatable about the rotation axis extending in the direction crossing (preferably in the direction orthogonal to) the direction in which the developing cartridge 4 is attached/detached to/from the image forming apparatus 100 in the posture in which the developing cartridge 4 is attached/detached to/from the image forming apparatus 100. In addition, as shown in FIG. 7, a torsion coil spring 50 is attached between the near-side restricting member 60 and the front-side end member 37 to urge the near-side restricting member 60 in one direction in the rotating direction of the near-side restricting member 60. The torsion coil spring 50 corresponds to an urging member or a one-end side urging member. The torsion coil spring 50 urges the near-side restricting member 60 in a direction in which the near-side restricting member 60 and a groove portion 20*c* (corresponding to a restricted portion or a one-end side restricted portion) that will be described later engage with each other. As shown in FIGS. 1A and 1B, the near-side restricting member 60 is urged by the urging force of the torsion coil spring 50 to an abutment portion 37*d* serving as the restricting portion of the front-side end member 37. The near-side restricting member 60 rotates in a direction in which the near-side restricting member 60 and the groove portion 20*c* engage with each other, and the abutment portion 37*d* controls or restricts the rotation of the near-side restricting member 60 at a prescribed position to prevent the cancellation of the engagement between the near-side restricting member 60 and the groove portion 20*c*.

Meanwhile, as shown in FIGS. 1A and 1B and FIG. 10, the gear cover 20 is provided with the groove portion 20*c* that engages with a restricting portion 60*a* of the near-side restricting member 60. Here, as shown in FIG. 10, the groove portion 20*c* is a groove formed by ribs 20*b*1 and 20*b*2. In addition, as described above, the gear cover 20 is provided with the boss 20*a*, and the front-side end member 37 is rotatable with the boss 20*a* as a central axis.

In addition, the front-side end member 37 is provided with the hook hole 37*a* capable of engaging with the boss 20*a*. Further, in a state in which the boss 20*a* of the gear cover 20 and the hook hole 37*a* have engaged with each other and the restricting portion 60*a* of the near-side restricting member 60 and the groove portion 20*c* of the gear cover 20 have engaged with each other, the front-side end member 37 is attached to the gear cover 20. As described above, the front-side end member 37 is attached to the gear cover 20 to make it possible to control or restrict the rotation of the front-side end member 37 with the boss 20*a* as the central axis. Further, in a state in which the developing cartridge 4 has not been attached to the image forming apparatus 100, the near-side restricting member 60 takes a posture shown in FIG. 1A.

Further, when a contact portion 60*b* of the near-side restricting member 60 comes in contact with the main-body attachment lower guide portion 104 as the developing cartridge is inserted in the image forming apparatus 100, the near-side restricting member 60 rotates in an R direction. Thus, as shown in FIG. 1B, the engagement between the restricting portion 60*a* of the near-side restricting member 60 and the groove portion 20*c* of the gear cover 20 is cancelled. That is, in the embodiment, the main-body attachment lower guide portion 104 has the function of cancelling the engagement by the near-side restricting member 60 as an engagement cancelling portion. At this time, the restricting portion 60*a* does not overlap with the groove portion 20*c* when seen from a direction orthogonal to the direction of the rotation axis Y (corresponding to the first rotation axis direction) of the developing unit 39. In this state, the gear cover 20 and the developing frame body 31 are made to be rotatable about the boss 20*a* with respect to the front-side end member 37.

Figure 11:
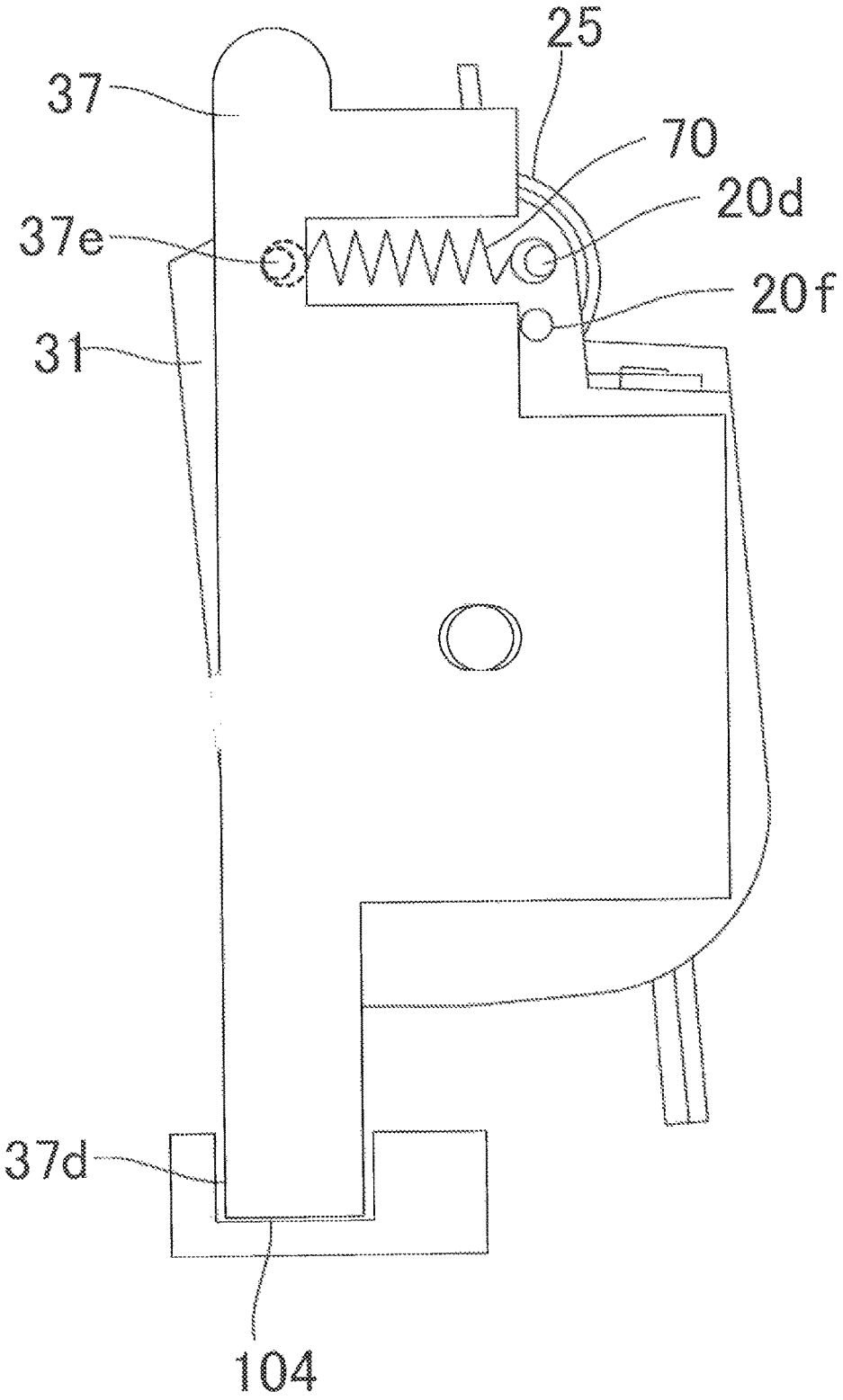
FIG. 11 is a modified example of the developing cartridge according to the first embodiment.

Here, in the embodiment, the restricting portion 60*a* of the near-side restricting member 60 and the groove portion 20*c* of the gear cover 20 engage with each other to control or restrict the rotation of the front-side end member 37 with respect to the gear cover 20. However, the configuration is not necessarily limited to the above one and other configurations may be employed. For example, as shown in FIG. 11, a tension spring 70 may be configured to be attached between the boss 37*e* of the front-side end member 37 and a boss 20*d* of the gear cover 20 such that the front-side end member 37 comes in contact with the boss 20*f* of the gear cover 20. In this case, the front-side end member 37 comes in contact with the boss 20*f* of the gear cover 20 to prevent the rotation of the front-side end member 37 with respect to the gear cover 20.

(Positioning of Developing Cartridge with Respect to Image Forming Apparatus)

Figure 12:
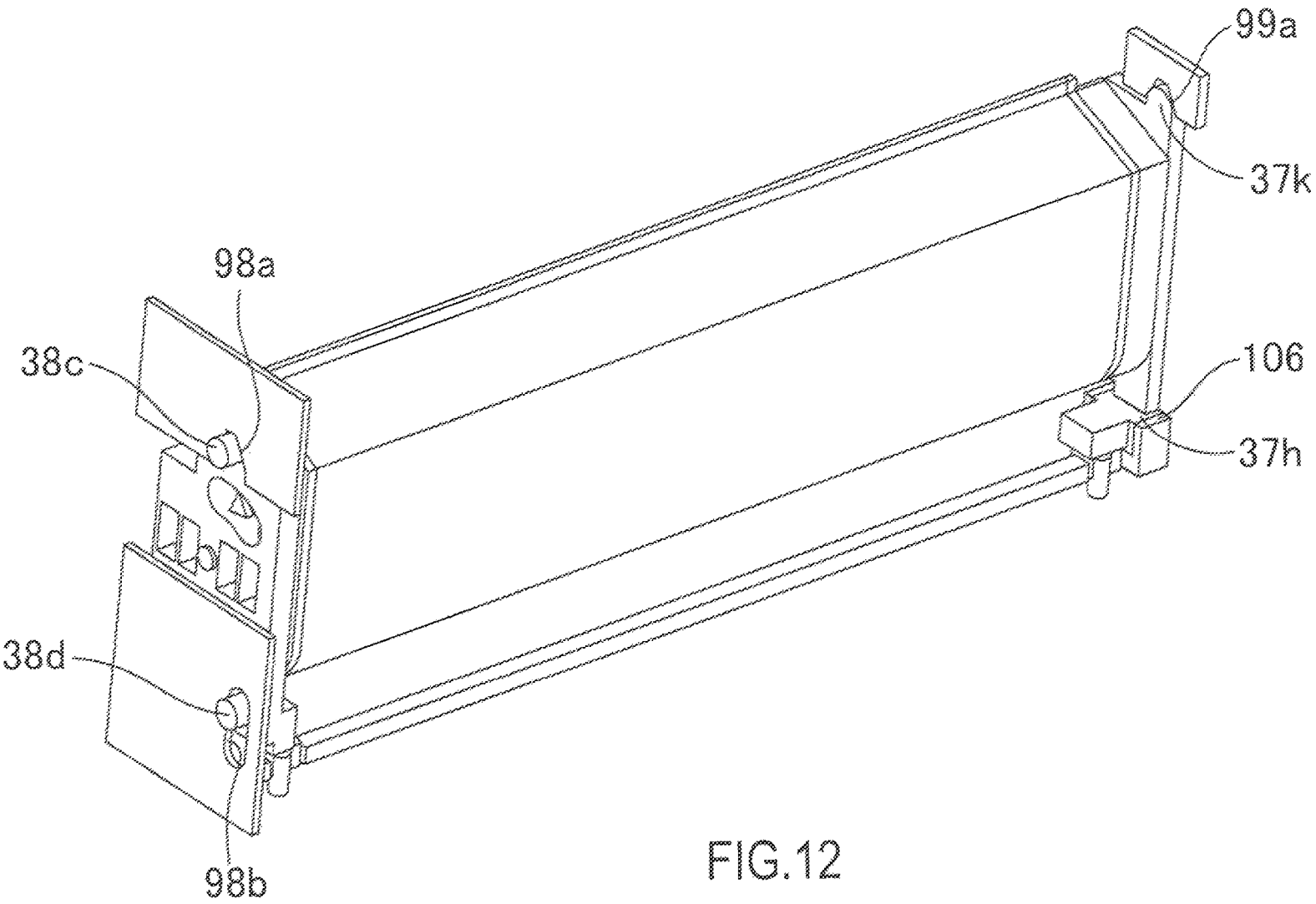
FIG. 12 is a view showing a state in which the developing cartridge according to the first embodiment has been positioned with respect to the image forming apparatus.

Next, a description will be given, with reference to FIG. 12, of the configuration of positioning the developing cartridge 4 with respect to the image forming apparatus 100. As shown in FIG. 12, the front-side end member 37 is provided with the guided portion 37*k* (having also a function as a one-end side positioned portion) and the guided portion 37*h* (having also a function as a one-end side rotation stop portion). On the other hand, the apparatus main body of the image forming apparatus 100 is provided with a main-body first positioning portion 99*a* (corresponding to a first positioning portion) and a main-body first rotation stop portion 106 (corresponding to a first rotation stop portion). Further, in a state in which the attachment of the developing cartridge 4 to the image forming apparatus 100 has been completed, the guided portion 37*k* and the main-body first positioning portion 99*a* engage with each other and the guided portion 37*h* and the main-body first rotation stop portion 106 engage with each other. Thus, the front-side end member 37 is positioned with respect to the apparatus main body of the image forming apparatus 100.

In addition, the back-side end member 38 is provided with a second positioned portion 38*c* (corresponding to the other-end side positioned portion) and a second rotation stop portion 38*d* (corresponding to the other-end side rotation stop portion). On the other hand, the apparatus main body of the image forming apparatus 100 is provided with a main-body second positioning portion 98*a* (corresponding to a second positioning portion) and a main-body second rotation stop portion 98*b* (corresponding to a second rotation stop portion). Further, in a state in which the attachment of the developing cartridge 4 to the image forming apparatus 100 has been completed, the second positioned portion 38*c* and the main-body second positioning portion 98*a* engage with each other and the second rotation stop portion 38*d* and the main-body second rotation stop portion 98*b* engage with each other. Thus, the back-side end member 38 is positioned with respect to the apparatus main body of the image forming apparatus 100.

Further, as described above, the back-side restricting member 40 is pressed by the engagement cancelling portion 90 (see FIG. 22) in conjunction with the attachment operation of the developing cartridge 4 to the apparatus main body of the image forming apparatus 100. Thus, the engagement between the back-side restricting member 40 and the groove portion 38*f* is cancelled, and the back-side developing bearing 13 is made to be rotatable with respect to the back-side end member 38. On the other hand, on the side of the front-side end member 37, the contact portion 60*b* of the near-side restricting member 60 comes in contact with the main-body attachment lower guide portion 104 in conjunction with the attachment operation of the developing cartridge 4 to the apparatus main body of the image forming apparatus 100. Thus, the near-side restricting member 60 rotates, and the front-side end member 37 is made to be rotatable with respect to the gear cover 20.

As described above, in the embodiment, in a state before the developing cartridge 4 has been attached to the image forming apparatus 100, the gear cover 20 and the back-side developing bearing 13 are positioned with respect to the front-side end member 37 and the back-side end member 38, respectively, which are to be guided by the apparatus main body during the attachment. Thus, it is possible to prevent the developing roller 25 from contacting the photosensitive drum 1 in the attachment operation of the developing cartridge 4 to the apparatus main body of the image forming apparatus 100. Further, in a state in which the attachment of the developing cartridge 4 to the image forming apparatus 100 has been completed, the gear cover 20 and the back-side developing bearing 13 are made to be rotatable with respect to the front-side end member 37 and the back-side end member 38, respectively, and the developing roller 25 and the photosensitive drum 1 are made to be capable of coming in contact with each other and separating from each other. As described above, in the embodiment, it is possible to fix the posture of the developing unit 39 and prevent the developing roller 25 and the photosensitive drum 1 from rubbing against each other in the attachment/detachment operation of the developing cartridge 4 to/from the image forming apparatus 100. Note that in the embodiment, the position of the developing frame body 31 when the photosensitive drum 1 and the developing roller 25 come in contact with each other is defined as a developing position.

Figure 13:
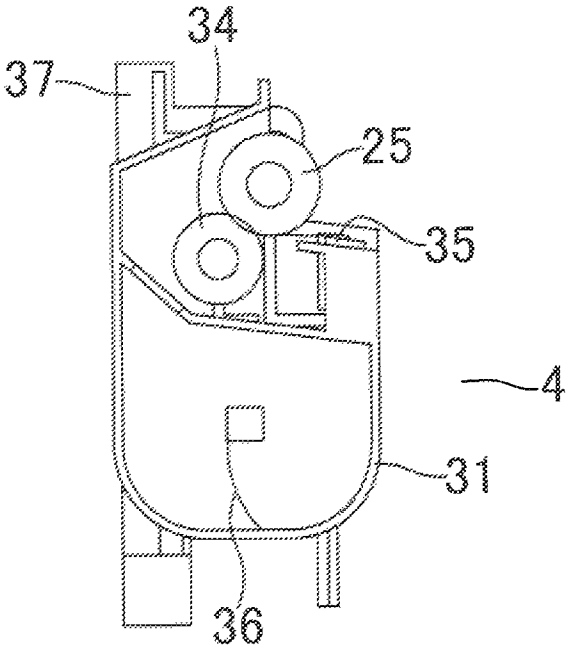
FIG. 13 are a perspective view and a cross-sectional view of the developing cartridge according to the first embodiment, respectively.
Figure 13:
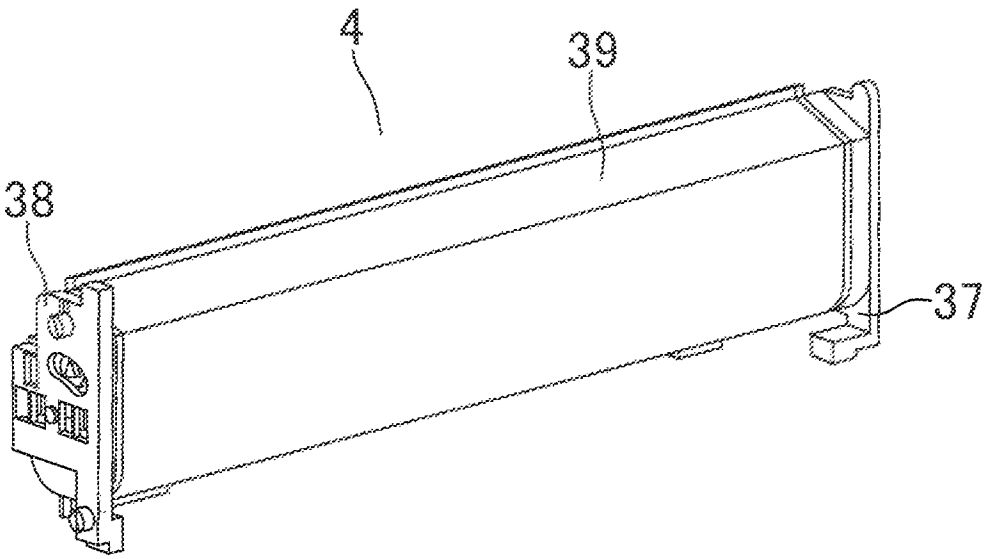
Figure 14:
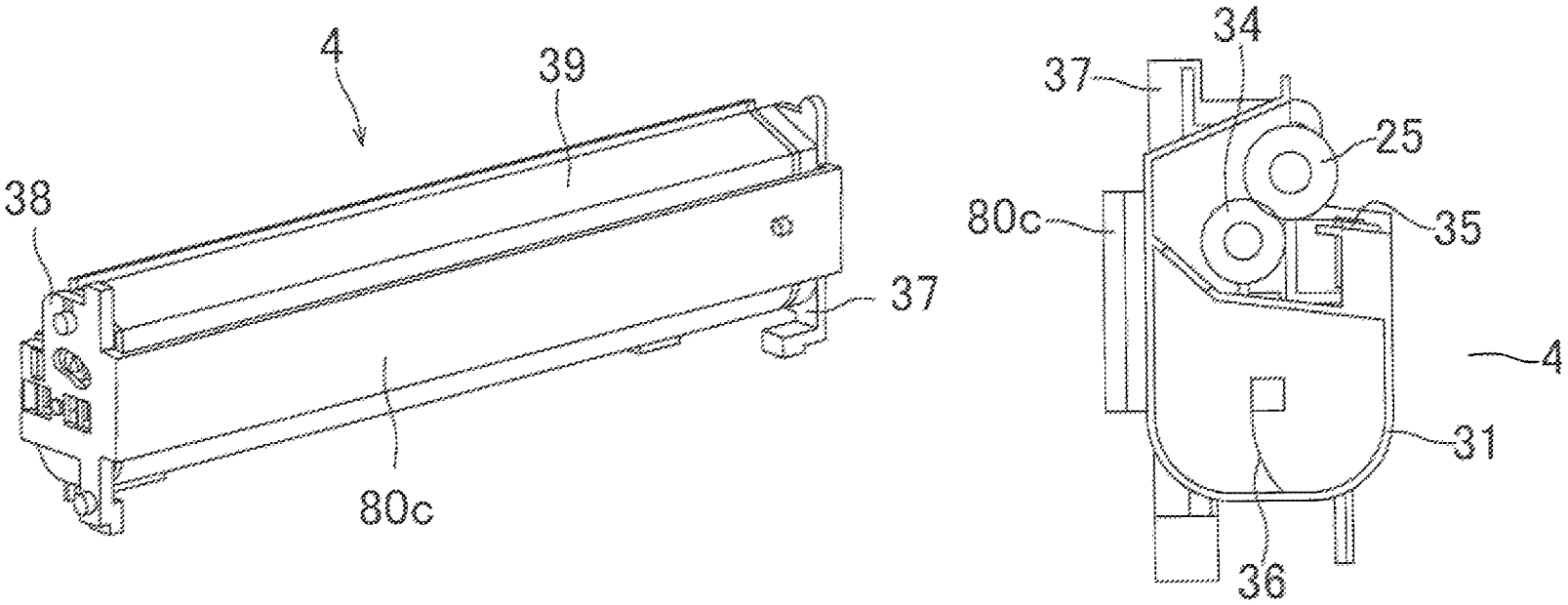
FIG. 14 a perspective view and a cross-sectional view of a developing cartridge in the related art, respectively.

FIG. 13 are a perspective view and a cross-sectional view of the developing cartridge 4 according to the embodiment, respectively. In addition, FIG. 14 a perspective view and a cross-sectional view of the developing cartridge 4 in the related art, respectively. In the related art, as shown in FIG. 14, by using a coupling member 80*c* that couples the front-side end member 37 and the back-side end member 38, the front-side end member 37 and the back-side end member 38 are coupled to each other. However, in the embodiment, the front-side end member 37 and the back-side end member 38 are configured to be separate members. The front-side end member 37 and the back-side end member 38 are made to be each independently rotatable with respect to the developing unit 39. In addition, the developing unit 39 is positioned by each of the front-side end member 37 and the back-side end member 38. Therefore, since the coupling member 80*c* as in the related art becomes unnecessary, it is possible to downsize the developing cartridge 4.

As described above, in the embodiment, in a state before the developing cartridge 4 has been attached to the image forming apparatus 100, the front-side end member 37 is positioned with respect to the developing unit 39. On the other hand, in a state in which the developing cartridge 4 has been attached to the image forming apparatus 100, the front-side end member 37 is made to be rotatable with respect to the developing unit 39. Thus, it is possible to prevent the developing roller 25 from contacting the photosensitive drum 1 in the attachment operation of the developing cartridge 4 to the image forming apparatus 100. In addition, in the embodiment, it is not necessary to increase the interval between the developing cartridge 4 and the photosensitive drum 1 to prevent the developing roller 25 from contacting the photosensitive drum 1 when the developing cartridge 4 is being inserted in the apparatus main body of the image forming apparatus 100. Thus, it is possible to prevent the upsize of the image forming apparatus.

In addition, in the embodiment, in a state before the developing cartridge 4 has been attached to the image forming apparatus 100, the back-side end member 38 is positioned with respect to the developing unit 39. On the other hand, in a state in which the developing cartridge 4 has been attached to the image forming apparatus 100, the back-side end member 38 is made to be rotatable with respect to the developing unit 39. Thus, it is possible to prevent the developing roller 25 from contacting the photosensitive drum 1 in the attachment operation of the developing cartridge 4 to the image forming apparatus 100. In addition, in the embodiment, it is not necessary to increase the interval between the developing cartridge 4 and the photosensitive drum 1 to prevent the developing roller 25 from contacting the photosensitive drum 1 when the developing cartridge 4 is being inserted in the apparatus main body of the image forming apparatus 100. Thus, it is possible to prevent the upsize of the image forming apparatus.

In addition, in the embodiment, the front-side end member 37 and the back-side end member 38 are configured to be separate members, and the developing unit 39 is positioned by each of the front-side end member 37 and the back-side end member 38. Therefore, since the coupling member 80*c* as in the related art becomes unnecessary, it is possible to downsize the developing cartridge 4.

In addition, in the embodiment, the front-side end member 37 and the back-side end member 38 are each independently movable with respect to the developing unit 39. Therefore, compared with a case in which the front-side end member 37 and the back-side end member 38 are integrated with each other, it is possible to further downsize the developing cartridge 4. Thus, it is possible to downsize the entire image forming apparatus.

Note that in the embodiment, the developing cartridge 4 is attachable/detachable to/from the image forming apparatus 100. However, other configurations may be employed. For example, a process cartridge having the developing cartridge 4, the photosensitive drum 1, and the charging roller 2 may be attachable/detachable to/from the image forming apparatus 100.

In addition, for example, a cleaning apparatus having the cleaning member 6 may be attachable/detachable to/from the apparatus main body of the image forming apparatus 100 and may be separately attachable/detachable to/from the developing cartridge 4. Alternatively, a photosensitive apparatus having the photosensitive drum 1 may be attachable/detachable to/from the apparatus main body of the image forming apparatus 100 and may be separately attachable/detachable to/from the developing cartridge 4.

Second Embodiment

Figure 15A:
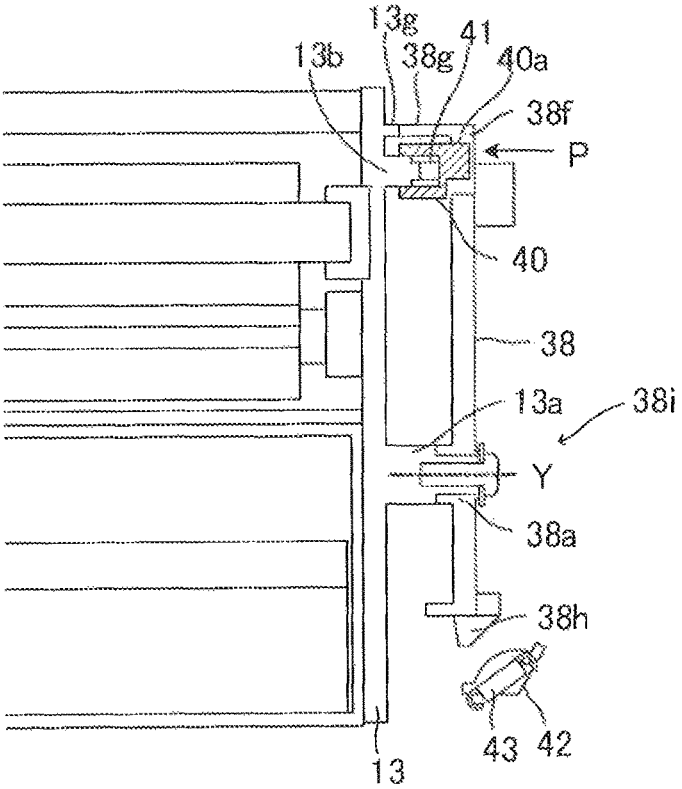
FIGS. 15A and 15B are partial cross-sectional views of the back-side end member according to a second embodiment.
Figure 15B:
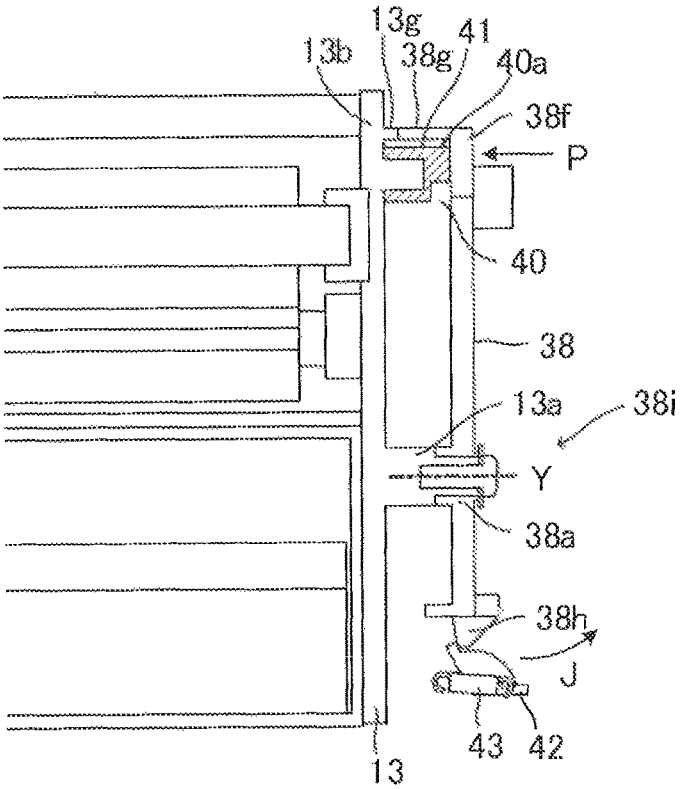
Figure 16:
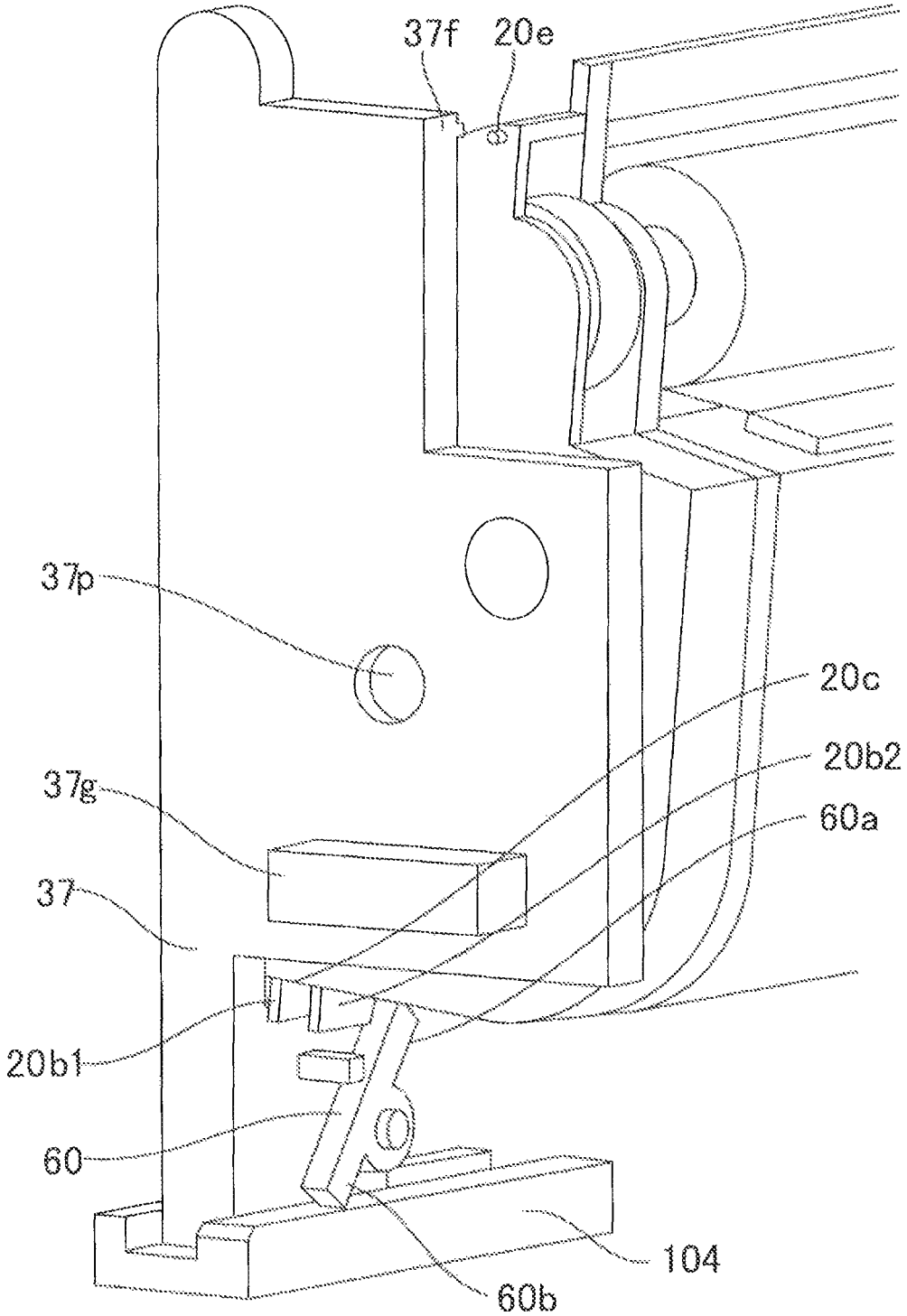
FIG. 16 is an external perspective view of the front-side end member according to the second embodiment.
Figure 17A:
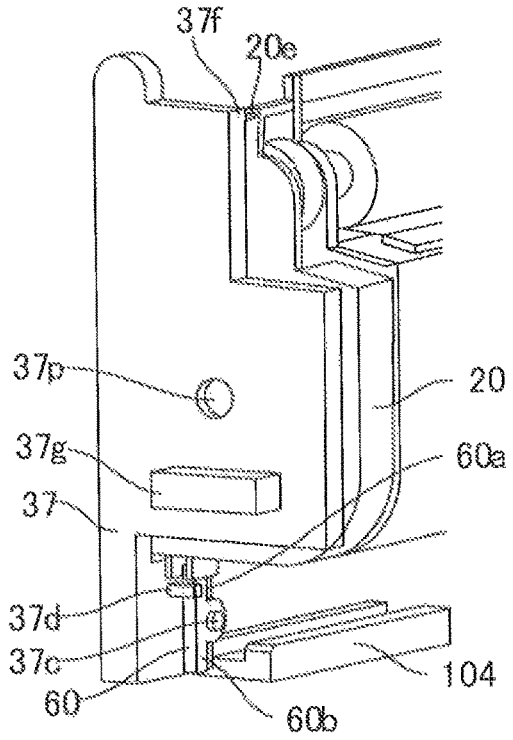
FIGS. 17A and 17B are external perspective views of a near-side end restricting member according to the second embodiment.
Figure 17B:
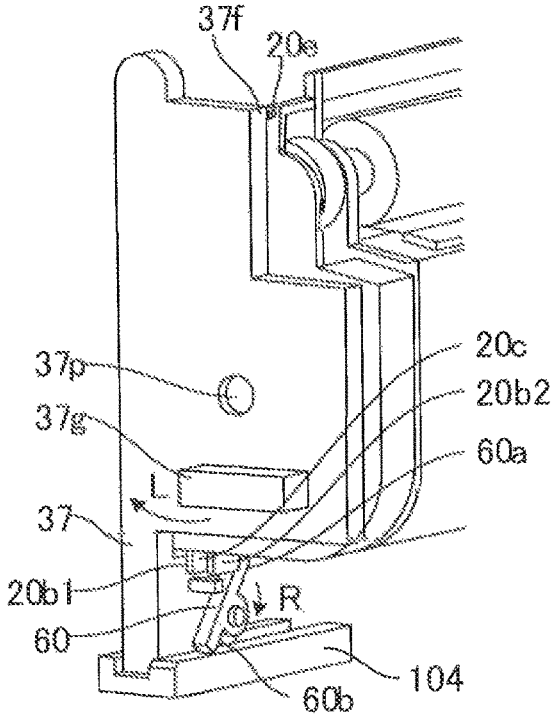
Figure 18A:
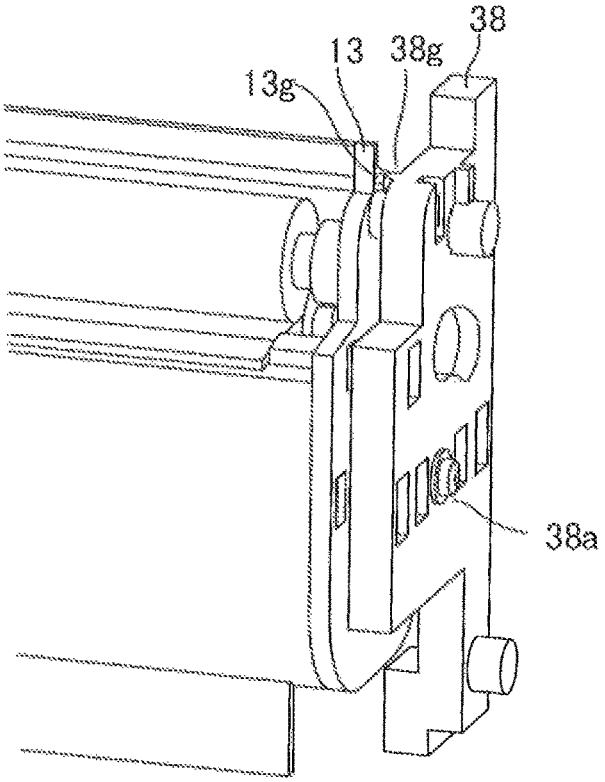
FIGS. 18A and 18B are external perspective views of the back-side end member according to the second embodiment.
Figure 18B:
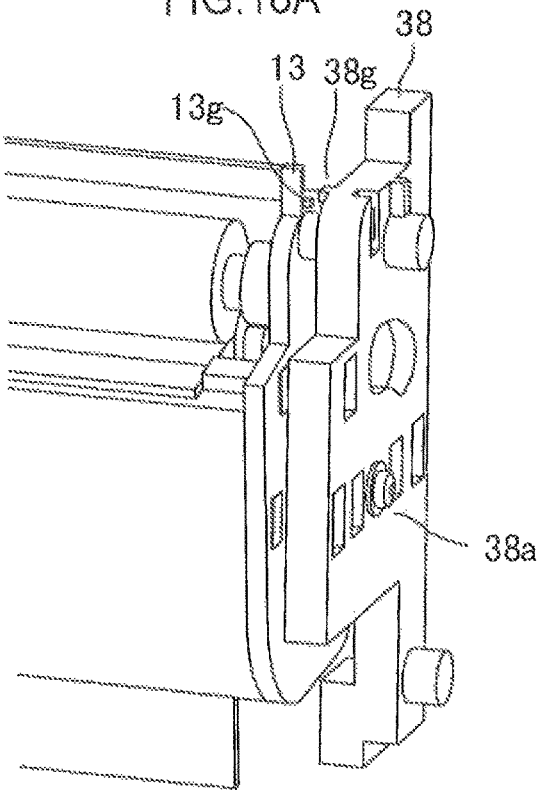

A description will be given of a second embodiment. Note that in the second embodiment, parts having the same functions as those of the first embodiment will be denoted by the same symbols and their descriptions will be omitted. FIGS. 15A and 15B are partial cross-sectional views of the back-side end member 38 according to the second embodiment. FIG. 16 is an external perspective view of the front-side end member 37 according to the second embodiment. FIGS. 17A and 17B are external perspective views of the near-side restricting member 60 according to the second embodiment. FIGS. 18A and 18B are external perspective views of the back-side end member 38 according to the second embodiment.

As shown in FIGS. 15A and 15B, the back-side end member 38 has an abutment portion 38*g*, and the back-side developing bearing 13 has an abutment portion 13*g*. In addition, the apparatus main body of the image forming apparatus 100 is provided with a drawing member 42 that draws the developing cartridge 4 in the direction in which the developing cartridge 4 is inserted. When the developing cartridge 4 is inserted up to a position at which a drawing-force receiving portion 38*h* of the back-side end member 38 and the drawing member 42 provided on the apparatus main body of the image forming apparatus 100 come in contact with each other, the drawing member 42 is pressed by the drawing-force receiving portion 38*h*. Here, the drawing member 42 is pressed by the drawing-force receiving portion 38*h* toward the direction in which the developing cartridge 4 is inserted in the apparatus main body of the image forming apparatus 100. When the drawing member 42 is pressed by the drawing-force receiving portion 38*h*, the drawing member 42 of the apparatus main body of the image forming apparatus 100 rotates by the urging force of the spring 43 as shown in FIGS. 15A and 15B. Further, a part of the drawing member 42 of the apparatus main body of the image forming apparatus 100 presses the drawing-force receiving portion 38*h* in the direction in which the developing cartridge 4 is inserted.

Here, when the developing cartridge 4 is pulled out from the apparatus main body of the image forming apparatus 100, the developing cartridge 4 is pulled out against the drawing force of the drawing member 42 to draw the developing cartridge 4. Therefore, in the back-side end member 38, moment occurs in a J direction in FIG. 15B about a second rotation center 38*i* (the engagement portion between the hook hole 38*a* and the boss 13*a*). Here, in the embodiment, the abutment portion 38*g* of the back-side end member 38 and the abutment portion 13*g* of the back-side developing bearing 13 come in contact with each other. Therefore, it is possible to prevent the back-side end member 38 from rotating in the J direction about the second rotation center 38*i*.

In addition, in the embodiment, the front-side end member 37 is provided with an abutment portion 37*f*, and the gear cover 20 is provided with an abutment portion 20*e* as shown in FIGS. 17A and 17B. Moreover, the front-side end member 37 is provided with a handle 37*g*, and the handle 37*g* is held when the developing cartridge 4 is pulled out from the apparatus main body of the image forming apparatus 100. Therefore, in the front-side end member 37, moment occurs in an L direction in FIG. 17B about a first rotation center 37*p* (the engagement portion between the hook hole 37*a* and the boss 20*a*). However, in the embodiment, the abutment portion 37*f* of the front-side end member 37 and the abutment portion 20*e* of the gear cover 20 come in contact with each other. Therefore, in the embodiment, it is possible to prevent the front-side end member 37 from rotating in the L direction about the first rotation center 37*p*.

Next, a description will be given, with reference to FIG. 16, FIGS. 17A and 17B, and FIGS. 18A and 18B, of an operation when the developing roller 25 of the developing unit 39 comes in contact with the photosensitive drum 1. When the developing cartridge 4 is attached/detached to/from the apparatus main body of the image forming apparatus 100, the abutment portions 37*f* and 20*e* come in contact with each other and the abutment portions 38*g* and 13*g* come in contact with each other as shown in FIGS. 17B and 18A.

Further, when the developing cartridge 4 is attached, the front-side end member 37 and the back-side end member 38 are positioned with respect to the apparatus main body of the image forming apparatus 100 and moreover the front-side end member 37 and the back-side end member 38 are made to be rotatable with respect to the developing unit 39. When the developing unit 39 is made to be rotatable about the first rotation center 37*p* of the front-side end member 37 and the second rotation center 38*i* of the back-side end member 38, the developing roller 25 of the developing unit 39 comes in contact with the photosensitive drum 1.

When the developing roller 25 and the photosensitive drum 1 come in contact with each other, the positions of the abutment portion 37*f* of the front-side end member 37 and the abutment portion 20*e* of the gear cover 20 are deviated from each other when seen from the axis direction of the developing roller 25 as shown in FIG. 16. The abutment portion 37*f* of the front-side end member 37 and the abutment portion 20*e* of the gear cover 20 are separated from each other. Similarly, when the developing roller 25 and the photosensitive drum 1 come in contact with each other, the positions of the abutment portion 38*g* of the back-side end member 38 and the abutment portion 13*g* of the back-side developing bearing 13 are deviated from each other when seen from the axis direction of the developing roller 25 as shown in FIG. 18B. The abutment portion 38*g* of the back-side end member 38 and the abutment portion 13*g* of the back-side developing bearing 13 are separated from each other.

Therefore, in a state in which the developing roller 25 has come in contact with the photosensitive drum 1, the abutment portion 37*f* of the front-side end member 37 and the abutment portion 20*e* of the gear cover 20 do not rub against each other. In addition, the abutment portion 38*g* of the back-side end member 38 and the abutment portion 13*g* of the back-side developing bearing 13 do not rub against each other. Thus, it is possible to prevent the force of the developing roller 25 of the developing unit 39 to press the photosensitive drum 1 from being reduced.

As described above, in the embodiment, the abutment portion 37*f* of the front-side end member 37 and the abutment portion 20*e* of the gear cover 20 come in contact with each other at a position away from the first rotation center 37*p* of the front-side end member 37. In addition, the abutment portion 38*g* of the back-side end member 38 and the abutment portion 13*g* of the back-side developing bearing 13 come in contact with each other at a position away from the second rotation center 38*i* of the back-side end member 38. Thus, it is possible to prevent the front-side end member 37 from being inclined with the first rotation center 37*p* as a fulcrum and prevent the back-side end member 38 from being inclined with the second rotation center 38*i* as a fulcrum. In addition, it is possible to improve operability in attaching/detaching the developing cartridge 4.

Third Embodiment

Figure 19:
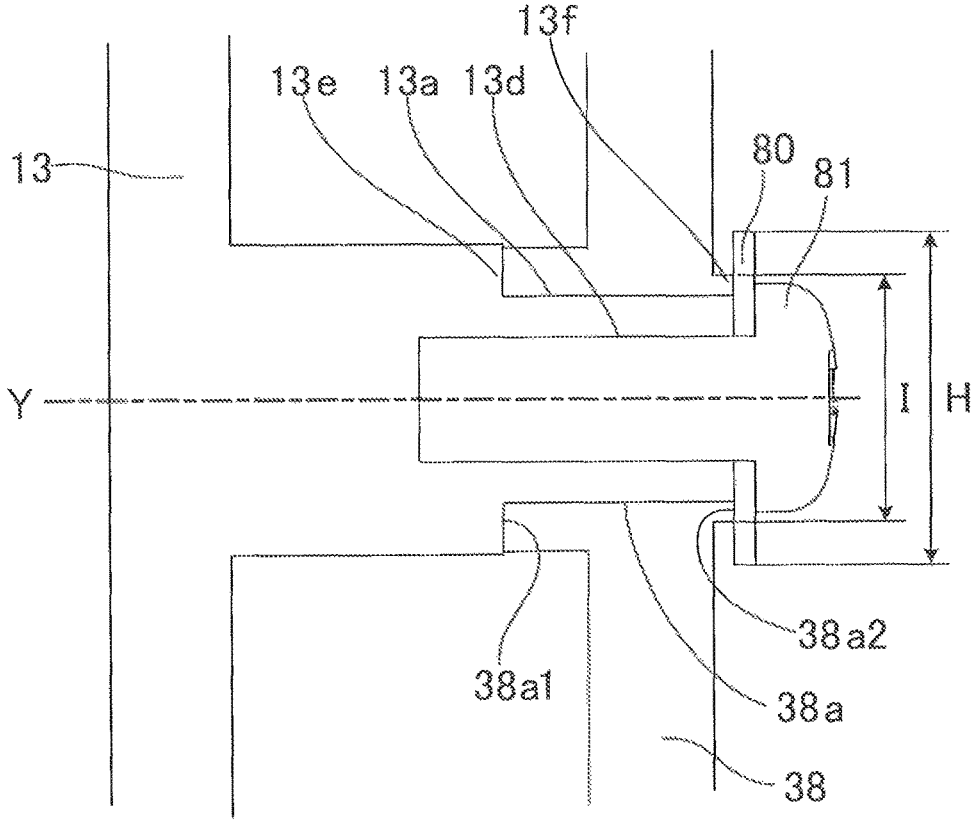
FIG. 19 is a schematic cross-sectional view of a coming-off preventing member according to a third embodiment.
Figure 20:
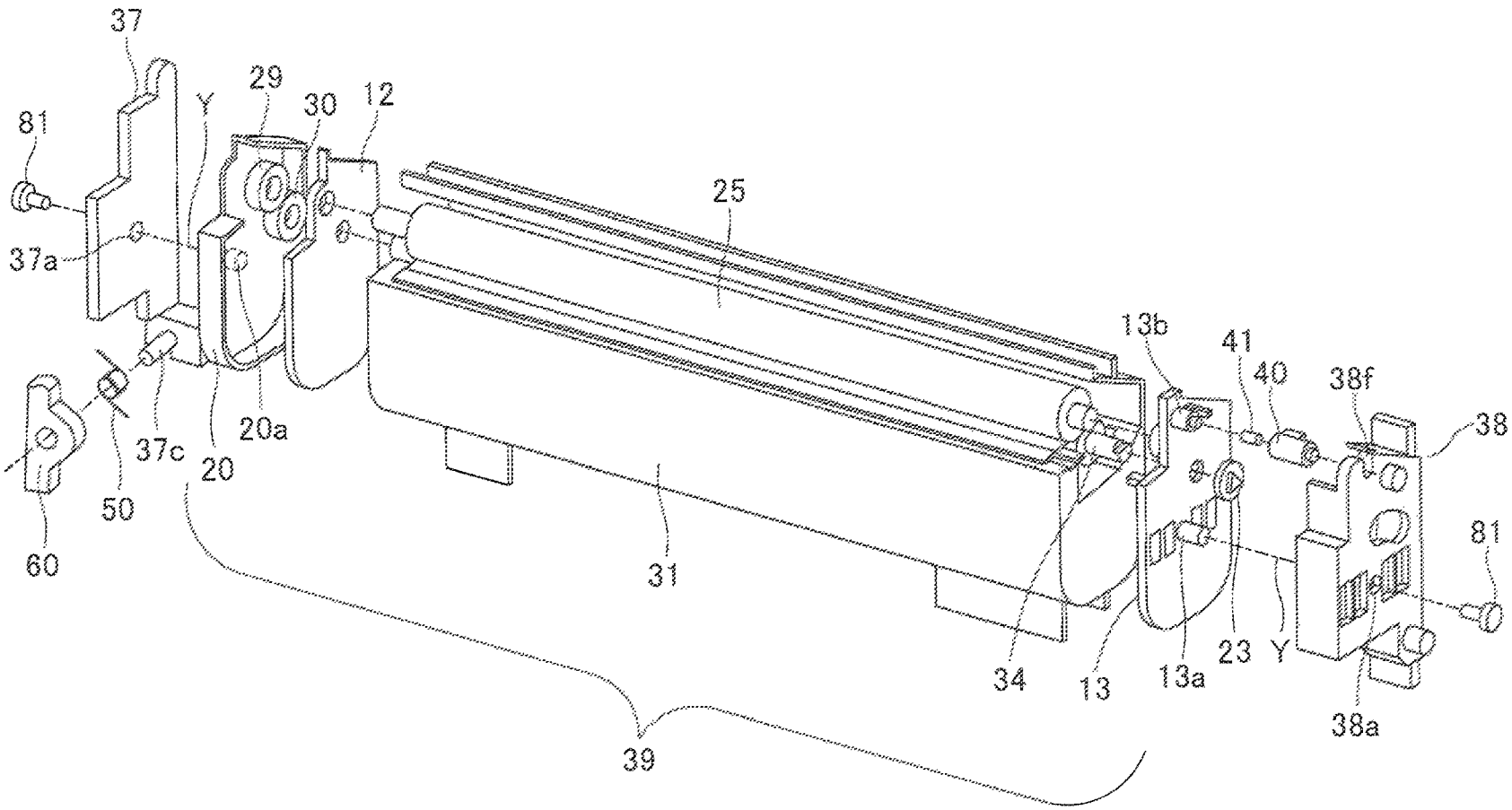
FIG. 20 is an exploded perspective view of the developing cartridge according to the third embodiment.
Figure 21A:
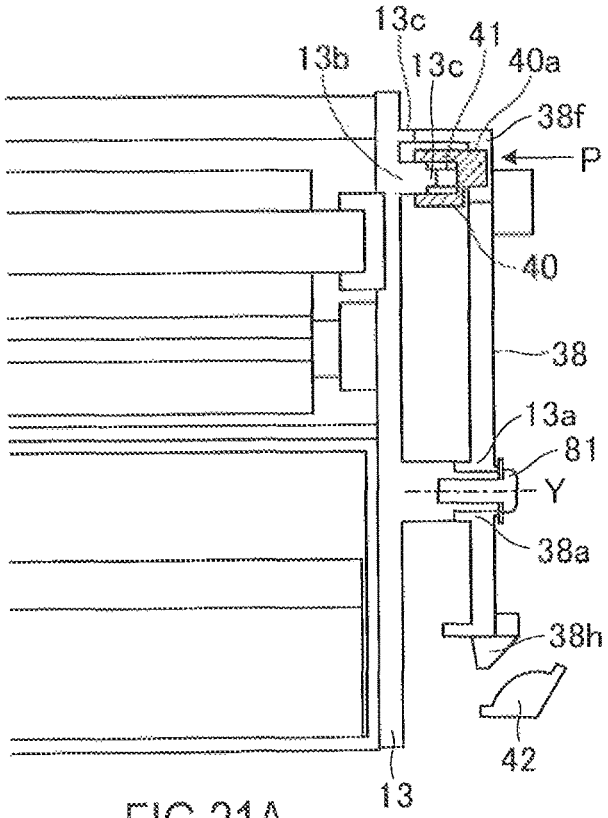
FIGS. 21A and 21B are schematic cross-sectional views of the back-side end member according to the third embodiment.
Figure 21B:
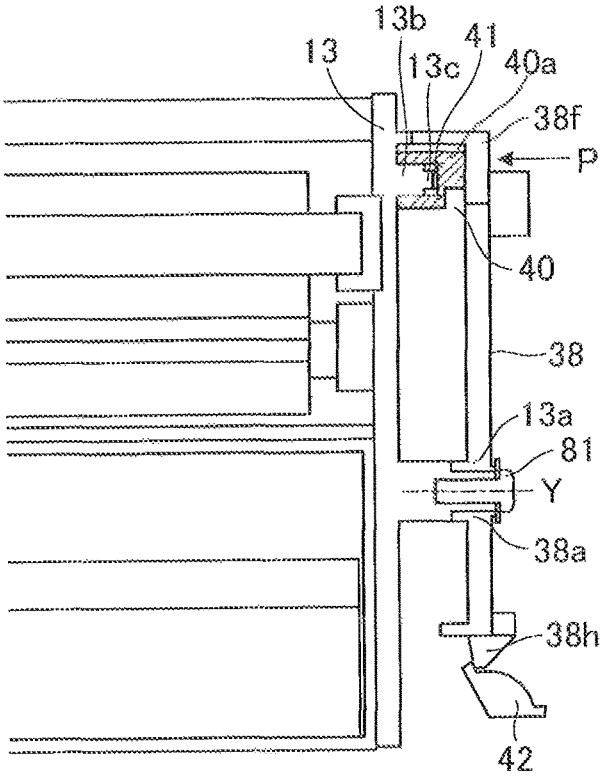

Next, a description will be given of a third embodiment. Here, in the third embodiment, parts having the same functions as those of the first embodiment will be denoted by the same symbols and their descriptions will be omitted. FIG. 19 is a schematic cross-sectional view of a coming-off preventing member (corresponding to a screw 81 and a washer 80) according to the third embodiment. FIG. 20 is an exploded perspective view of the developing cartridge 4 according to the third embodiment. FIGS. 21A and 21B are schematic cross-sectional views of the back-side end member 38 according to the third embodiment.

A description will be given, with reference to FIG. 19 to FIGS. 21A and 21B, of the configuration of preventing the back-side end member 38 from coming off the boss 13*a* of the back-side developing bearing 13 in the direction of the rotation axis Y of the back-side end member 38. In the embodiment, the back-side end member 38 is attached to the back-side developing bearing 13 so as to make a one-end surface 38*a*1 of the hook hole 38*a* of the back-side end member 38 come in contact with a surface 13*e* of the root portion of the boss 13*a*.

Further, in a state in which the back-side end member 38 has been attached to the back-side developing bearing 13, the screw 81 is inserted in a screw portion 13*d* of the boss 13*a*. At this time, the washer 80 is held between a leading surface 13*f* of the boss 13*a* and the head of the screw 81. Note that in the embodiment, the screw 81 and the washer 80 constitute the coming-off preventing member. Here, in the back-side end member 38, the length of the hook hole 38*a* positioned between the one-end surface 38*a*1 and the other-end surface 38*a*2 (the length of the back-side end member 38 in the direction of the rotation axis Y) is set to be smaller than a size from the surface 13*e* of the root portion to the leading surface 13*f*. Thus, the part of the hook hole 38*a* of the back-side end member 38 is rotatably supported about the rotation axis Y of the back-side end member 38 between the surface 13*e* of the root portion of the boss 13*a* and the washer 80. In addition, since the other-end surface 38*a*2 of the back-side end member 38 collides with the washer 80, it is possible to prevent the back-side end member 38 from coming off the back-side developing bearing 13 in the direction of the rotation axis Y of the back-side end member 38.

As described above, the length of the hook hole 38*a* is set to be smaller than the size between the surface 13*e* of the root portion of the boss 13*a* and the washer 80 in the direction of the rotation axis Y of the back-side end member 38. Therefore, a gap is caused between the back-side end member 38 and the surface 13*e* of the root portion of the boss 13*a* and the washer 80. Thus, there is a likelihood that the back-side end member 38 is inclined with respect to the rotation axis Y of the back-side end member 38. Here, in the embodiment, an outermost shape I of the other-end surface 38*a*2 of the back-side end member 38 is set to be smaller than an outermost shape H of the washer 80. Thus, when the back-side end member 38 is inclined, the edge portion of the outermost shape H of the washer 80 is prevented from interfering with the back-side end member 38.

Note that the other-end surface 38*a*2 is the abutment surface of the back-side end member 38 that prevents the back-side end member 38 from coming off the back-side developing bearing 13. That is, the other-end surface 38*a*2 of the back-side end member 38 comes in contact with only the plane portion of the washer 80. Accordingly, the back-side end member 38 is allowed to smoothly rotate with respect to the developing unit 39. Thus, it is possible to prevent the force of the developing roller 25 of the developing unit 39 to press the photosensitive drum 1 from being reduced. Note that in the embodiment, the screw 81 and the washer 80 are separate members. However, the configuration is not necessarily limited to the above one. For example, the screw 81 and the washer 80 may be integrated with each other. In addition, in order to further prevent the back-side end member 38 from coming off the back-side developing bearing 13, a nut serving as a separate body may be embedded in the boss 13*a* to be molded as the screw portion 13*d* of the boss 13*a*. Note that in the embodiment, the front-side end member 37 is also prevented from coming off the boss 20*a* by the washer 80 and the screw 81 like the back-side end member 38 as shown in FIG. 20.

Fourth Embodiment

A description will be given of the developing cartridge 4 serving as the developing apparatus according to a fourth embodiment.

Figure 23:
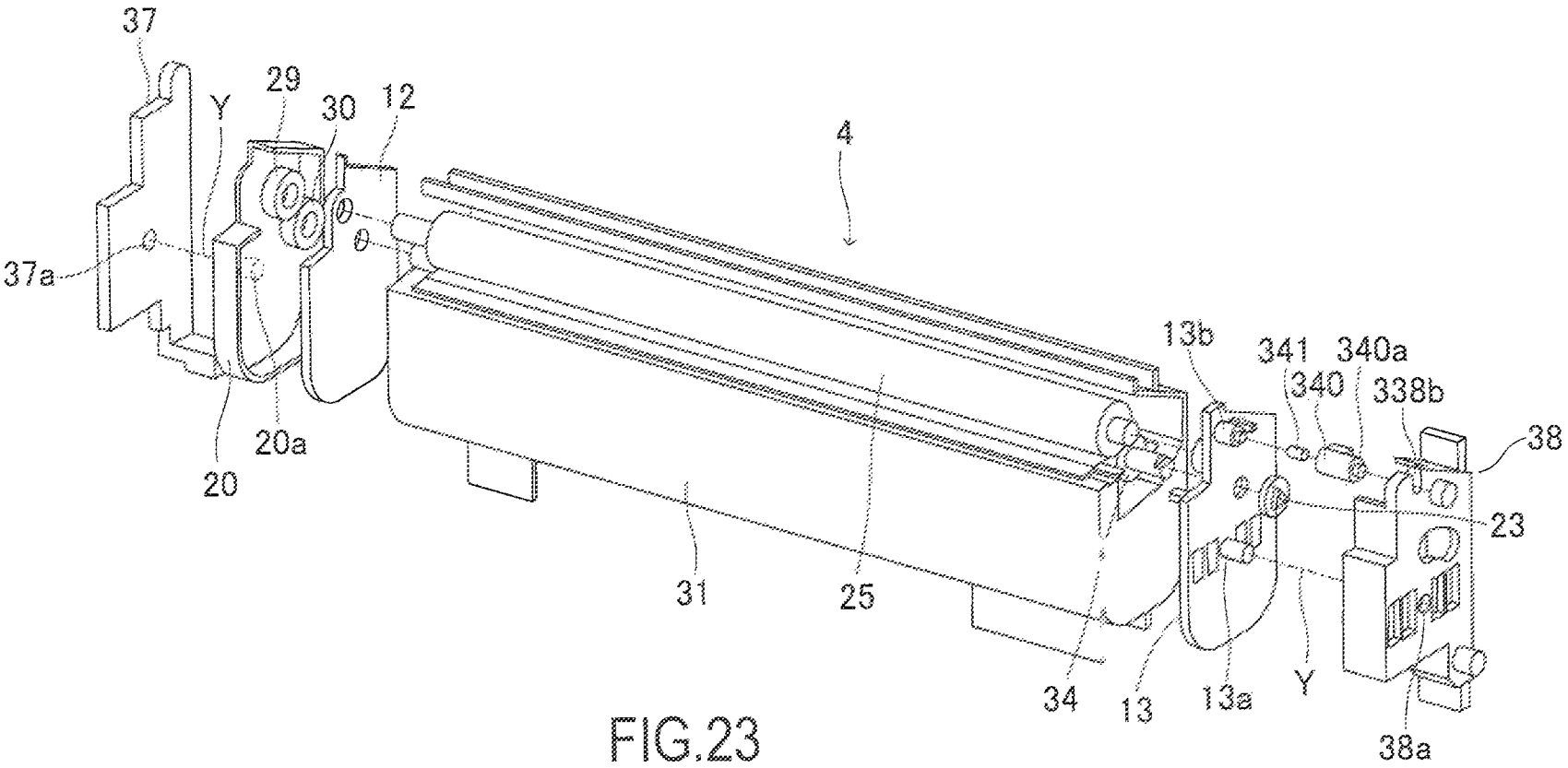
FIG. 23 is an exploded perspective view of the developing cartridge according to a fourth embodiment.

In the fourth embodiment as well, as shown in FIG. 23, the developing roller 25 and the toner supply roller 34 are rotatably supported by the developing frame body 31 via the front-side developing bearing 12 and the back-side developing bearing 13 serving as parts of the developing frame body 31 provided on both sides in the rotation axis direction of the developing roller 25. At the back-side end of the toner supply roller 34, the developing coupling 23 is provided. In addition, at the front-side end of the toner supply roller 34, the toner supply gear 30 is provided. At the front-side end of the developing roller 25, the developing gear 29 that meshes with the toner supply gear 30 is provided. Therefore, when a drive force is transmitted from the main-body drive motor (not shown) serving as a drive source to the developing coupling 23, the toner supply roller 34 and the developing roller 25 rotate and drive according to an image forming operation. In addition, the gear cover 20 serving as a part of the developing frame body 31 is provided outside the developing gear 29 and the toner supply gear 30.

At both ends of the developing frame body 31 in the rotation axis direction of the developing roller 25, the front-side end member 37 (corresponding to a one-end side member or a first end member) and the back-side end member 38 (corresponding to the other-side end member or a second end member) are provided. The back-side end member 38 is provided with the hook hole 38*a* (corresponding to the other-end side engaged portion) that engages with the boss 13*a* (corresponding to the other-end side engaging portion) provided on the back-side developing bearing 13. In addition, the front-side end member 37 is provided with the hook hole 37*a* (corresponding to a one-end side engaged portion) that engages with the boss 20*a* (corresponding to a one-end side engaging portion) provided on the gear cover 20. The front-side end member 37 and the back-side end member 38 are made to be rotatable with respect to the rotation axis Y connecting the boss 13*a* of the back-side developing bearing 13 and the boss 20*a* of the gear cover 20 to each other. Therefore, the front-side end member 37 and the back-side end member 38 are each independently rotatable with respect to the developing frame body 31.

That is, as shown in FIG. 23, the front-side end member 37 is configured to rotatably support a one-end side in the axis direction of the developing roller 25 of the developing unit 39 while being configured not to support the other-end side in the axis direction of the developing roller 25 of the developing unit 39. The back-side end member 38 is configured to rotatably support the other-end side in the axis direction of the developing roller 25 of the developing unit 39 while being configured not to support the one-end side in the axis direction of the developing roller 25 of the developing unit 39. That is, the front-side end member 37 and the back-side end member 38 are configured to support in the axis direction of the developing roller 25 one of the one-end side and the other-end side of the developing frame body 31 while being configured not to support the other of the one-end side and the other-end side of the developing frame body 31. In addition, the front-side end member 37 is made to be rotatable with respect to the developing frame body 31 and the back-side end member 38. The back-side end member 38 is made to be rotatable with respect to the developing frame body 31 and the front-side end member 37. In other words, when the front-side end member 37 rotates with respect to the developing frame body 31, the back-side end member 38 is allowed to stop with respect to the developing frame body 31 and the front-side end member 37. In addition, when the back-side end member 38 rotates with respect to the developing frame body 31, the front-side end member 37 is allowed to stop with respect to the developing frame body 31 and the back-side end member 38.

(Configuration of Movement Restricting Portion of Back-Side End Member)

Figure 24:
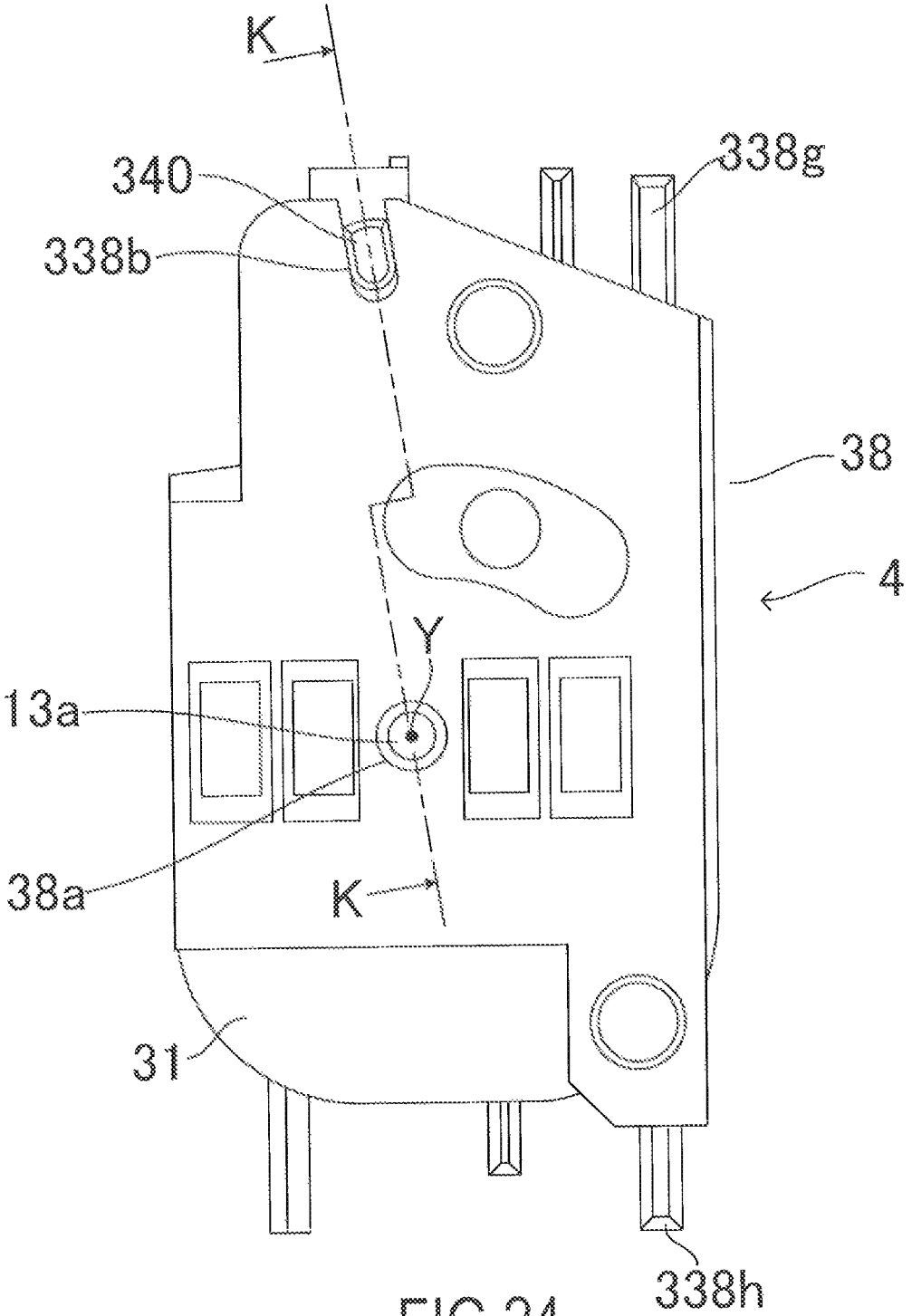
FIG. 24 is an external view of the developing cartridge when seen from the side of the back-side end member according to the fourth embodiment.
Figure 25A:
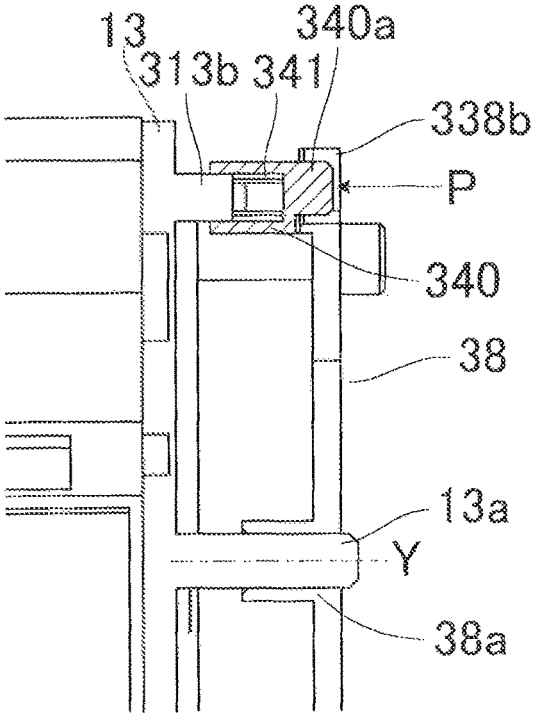
FIGS. 25A and 25B are cross-sectional views of the developing cartridge on the side of the back-side end member according to the fourth embodiment.
Figure 25B:
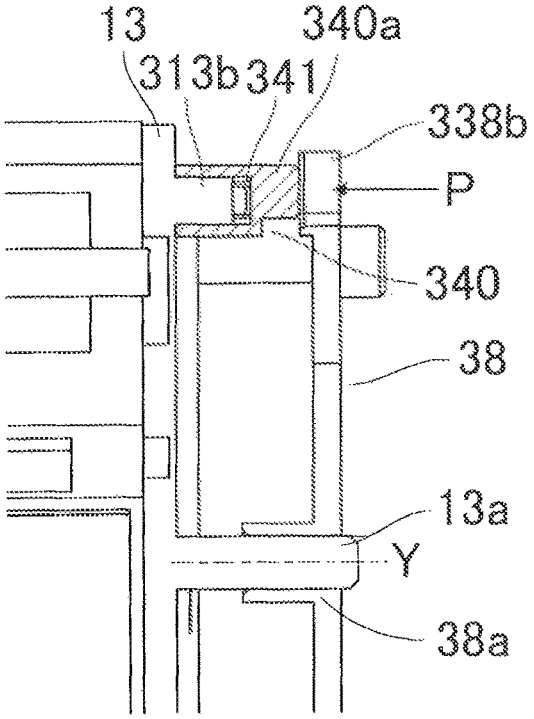

Next, a description will be given, with reference to FIG. 23 to FIGS. 25A and 25B, of the configuration of controlling or restricting the rotation of the back-side end member 38. FIG. 24 is a side view of the developing cartridge 4 according to the embodiment. FIGS. 25A and 25B are views (cross-sectional view taken along line K-K in FIG. 24) for describing the configuration of positioning the developing frame body 31 with respect to the back-side end member 38.

As shown in FIG. 23, a restricting member 340 (corresponding to a restricting member or the other-end side restricting member) serving as means for controlling or restricting the rotation of the back-side end member 38 is attached to the back-side developing bearing 13. In addition, inside the restricting member 340, a control spring 341 (corresponding to an urging member or the other-end side urging member) allowed to be attached to a spring support portion 313*b* of the back-side developing bearing 13 is provided. The control spring 341 applies an urging force acting in the direction in which the developing cartridge 4 is inserted to the restricting member 340. On the other hand, the back-side end member 38 is provided with a groove portion 338*b* (corresponding to a restricted portion or the other-end side restricted portion) capable of engaging with a restricting portion 340*a* of the restricting member 340. In addition, as described above, the back-side developing bearing 13 is provided with the boss 13*a* serving as the swing central shaft of the developing frame body 31, and the back-side end member 38 is provided with the hook hole 38*a* capable of engaging the boss 13*a*.

The back-side end member 38 is attached to the developing frame body 31 in a state in which the hook hole 38*a* and the boss 13*a* have engaged with each other and the restricting portion 340*a* of the restricting member 340 and the groove portion 338*b* have engaged with each other (see FIG. 24 and FIG. 25A). Therefore, when the back-side end member 38 and the restricting member 340 engage with each other, the rotation of the back-side end member 38 with the boss 13*a* as a central shaft is restricted. On the other hand, when the restricting member 340 is pressed in a P direction in FIGS. 25A and 25B in a state in which the back-side end member 38 and the restricting member 340 have engaged with each other, the restricting member 340 moves in the P direction with the control spring 341 arranged inside the restricting member 340 compressed. Then, the engagement between the restricting portion 340*a* of the restricting member 340 and the groove portion 338*b* of the back-side end member 38 is cancelled (see FIG. 25B). Thus, the developing frame body 31 is made to be rotatable with the boss 13*a* of the back-side developing bearing 13 as a central shaft with respect to the back-side end member 38.

As described above, when the back-side end member 38 and the restricting member 340 engage with each other to control or restrict the rotation of the back-side end member 38, the rotation of the developing frame body 31 is restricted with respect to the back-side end member 38 in a state in which the developing cartridge 4 has not been attached to the image forming apparatus 100. In addition, in a state in which the developing cartridge 4 has been attached to the image forming apparatus 100, the restricting member 340 is pressed in the P direction by a restrict cancelling portion (not shown) provided on the apparatus main body of the image forming apparatus 100. Thus, the engagement between the back-side end member 38 and the restricting member 340 is cancelled, whereby the back-side end member 38 is made to be rotatable (the back-side end member 38 is allowed to perform relative movement) with respect to the developing frame body 31.

Figure 27A:
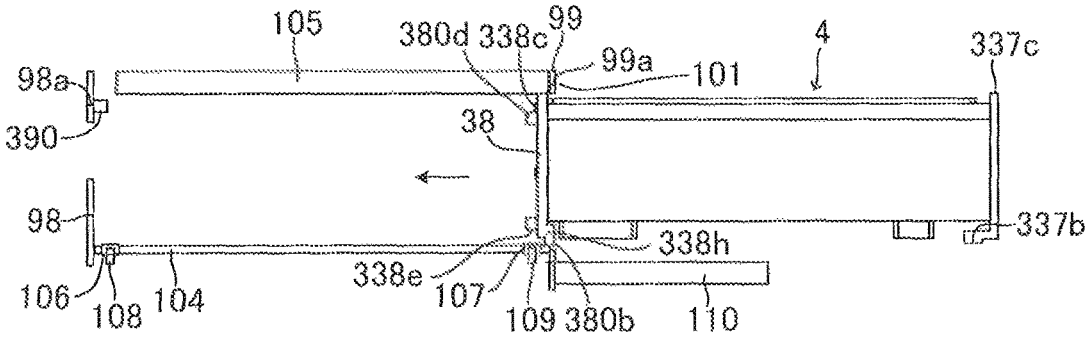
FIGS. 27A to 27C are views for describing the attachment of the developing cartridge according to the fourth embodiment.
Figure 27B:
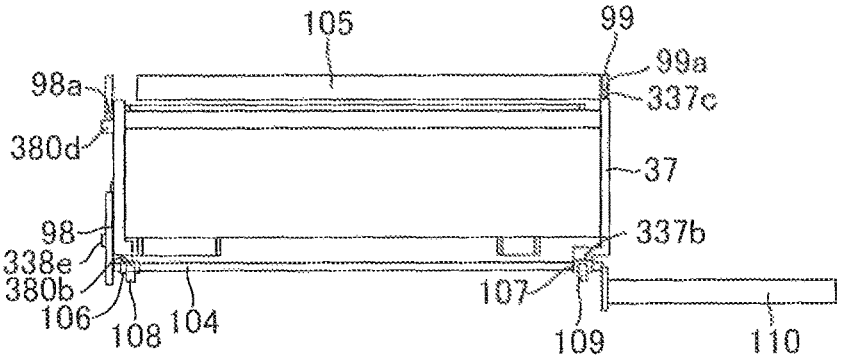
Figure 27C:
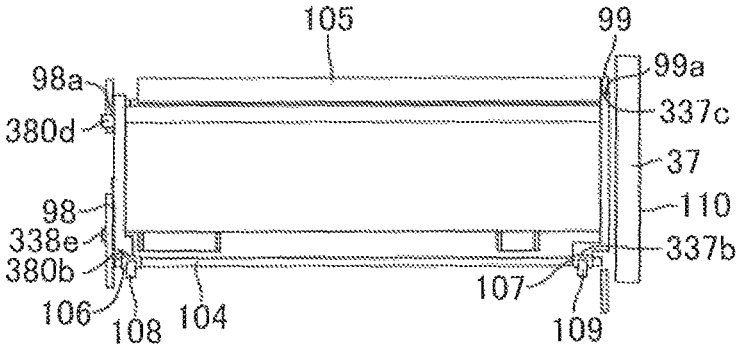
Figure 28:
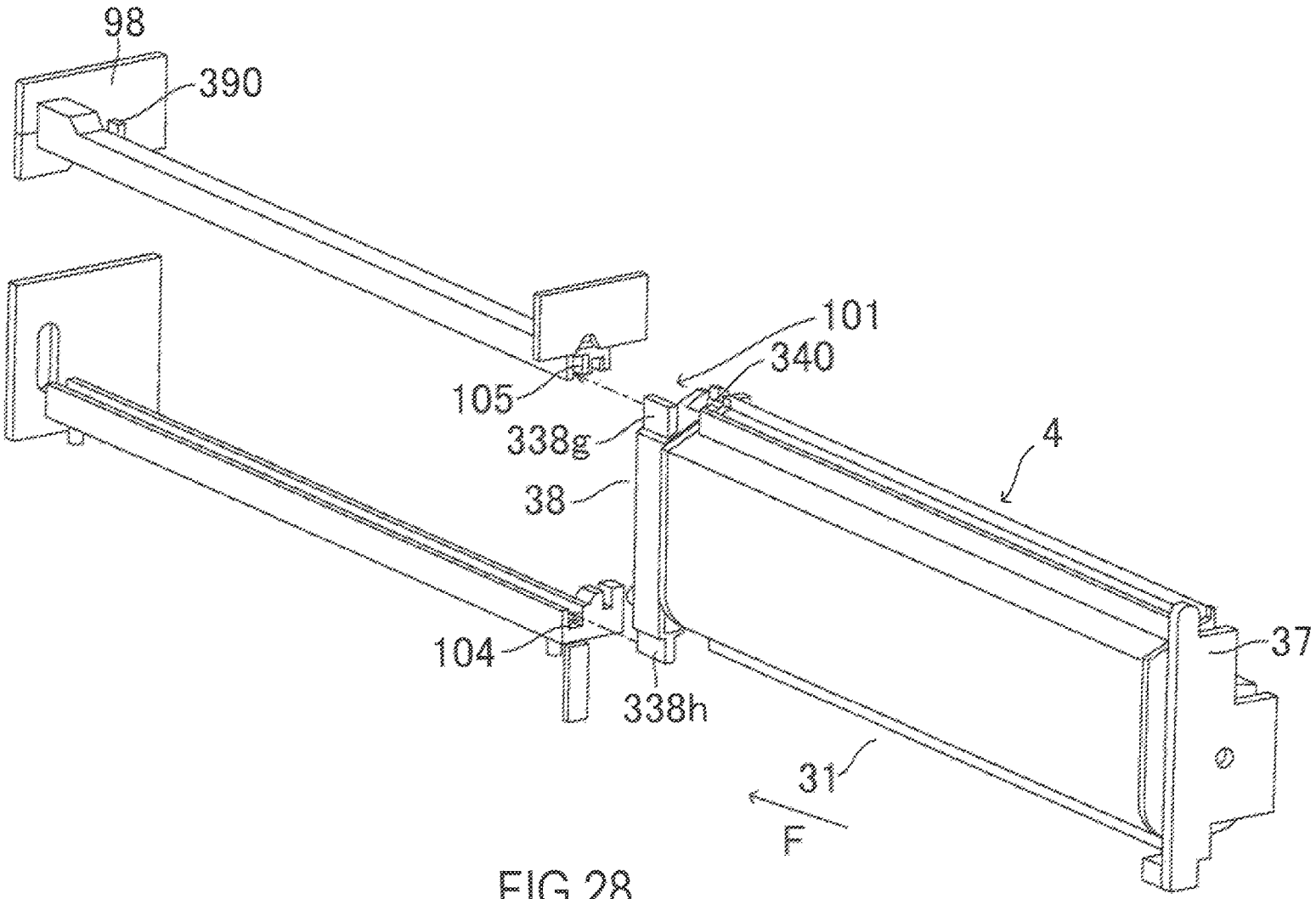
FIG. 28 is a view showing a state in which the developing cartridge according to the fourth embodiment is being attached to the image forming apparatus.

As shown in FIGS. 27A to 27C, an openable/closable front cover 110 is provided on the near side of the apparatus main body of the image forming apparatus 100. When the front cover 110 is opened, the opening portion 101 for inserting the developing cartridge 4 is exposed. In addition, as shown in FIG. 28, the upper side of the opening portion 101 is provided with the upper guide 105 (corresponding to a first guide portion) serving as a guide member extending from the near side to the back side. Here, in the embodiment, the upper guide 105 is formed in a groove shape (concave shape). In addition, the lower side of the opening portion 101 is provided with the lower guide 104 (corresponding to a second guide portion) serving as a guide member extending from the near side to the back side. In the embodiment, the lower guide 104 is formed in a groove shape (concave shape). In the embodiment as well, the developing cartridge 4 is inserted with the back-side end member 38 arranged on the downstream side in the inserting direction as shown in FIG. 28. That is, in the inserting direction, the back-side end member 38 is arranged on the downstream side of the front-side end member 37. In other words, the back-side end member 38 is arranged on the downstream side in the inserting direction with respect to the developing frame body, and the front-side end member 37 is arranged on the upstream side in the inserting direction with respect to the developing frame body 31.

In addition, as shown in FIG. 24, on the back-side end member 38, a first upper guide rib 338*g* (corresponding to the other-end side guided portion or a first guided portion) protrudes in an upper direction (substantially vertical direction in the embodiment) orthogonal to the attachment/detachment direction (horizontal direction in the embodiment) of the developing cartridge 4, and a first lower guide rib 338*h* (corresponding to the other-end side guided portion or a second guided portion) protrudes in a lower direction. Here, as described above, in a state in which the developing cartridge 4 has not been attached to the apparatus main body of the image forming apparatus 100, the rotation of the developing frame body 31 of the developing cartridge 4 with respect to the back-side end member 38 is restricted by the restricting member 340. Thus, in the embodiment, the image forming apparatus 100 has the restricting mechanism of controlling or restricting the rotation of the developing frame body 31 with respect to the back-side end member 38.

Figure 26:
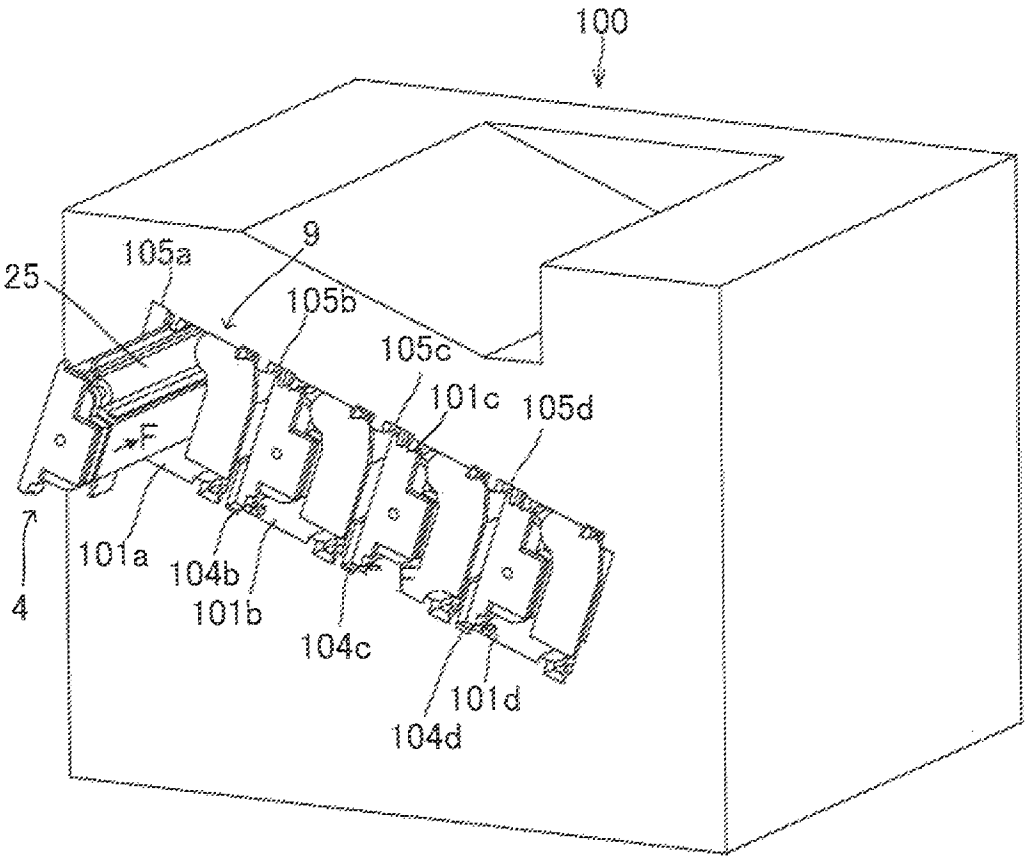
FIG. 26 is a view showing the operation of attaching the developing cartridge according to the fourth embodiment to the image forming apparatus.

Further, when the developing cartridge 4 is inserted in the apparatus main body of the image forming apparatus 100, the first upper guide rib 338*g* provided on the back-side end member 38 first engages with the upper guide 105 provided on the side of the apparatus main body of the image forming apparatus 100. In addition, the first lower guide rib 338*h* provided on the back-side end member 38 engages with the lower guide 104 provided on the side of the apparatus main body of the image forming apparatus 100. Further, in this state, the developing cartridge 4 is pressed in the arrow F direction in FIG. 26 to slide the first lower guide rib 338*h* against the lower guide 104. Further, when the developing cartridge 4 is inserted up to a prescribed position as it is, a mounting portion 380*b* of the first lower guide rib 338*h* of the back-side end member 38 is mounted on a back-side pressing member 106 provided on the back side of the first lower guide 104 as shown in FIG. 27B. In addition, a mounting portion 337*b* provided on the front-side end member 37 is mounted on a front-side pressing member 107 provided on the near side of the first lower guide 104.

In addition, an abutted portion 338*c* provided on the back-side end member 38 reaches and comes in contact with a back-side plate 98 of the apparatus main body of the image forming apparatus 100. Thus, the developing cartridge 4 is positioned in the direction in which the developing cartridge 4 is inserted. A position at which the abutted portion 338*c* and the back-side plate 98 come in contact with each other is an attachment position. In addition, the back-side plate 98 provided in the apparatus main body of the image forming apparatus 100 is provided with a control cancelling portion 390 that presses the restricting member 340 of the cartridge 4. In a state in which the developing cartridge 4 has been attached to the apparatus main body of the image forming apparatus 100, the engagement between the groove portion 338*b* of the back-side end member 38 and the restricting member 340 is cancelled when the restricting member 340 is pressed by the control cancelling portion 390.

Figure 29:
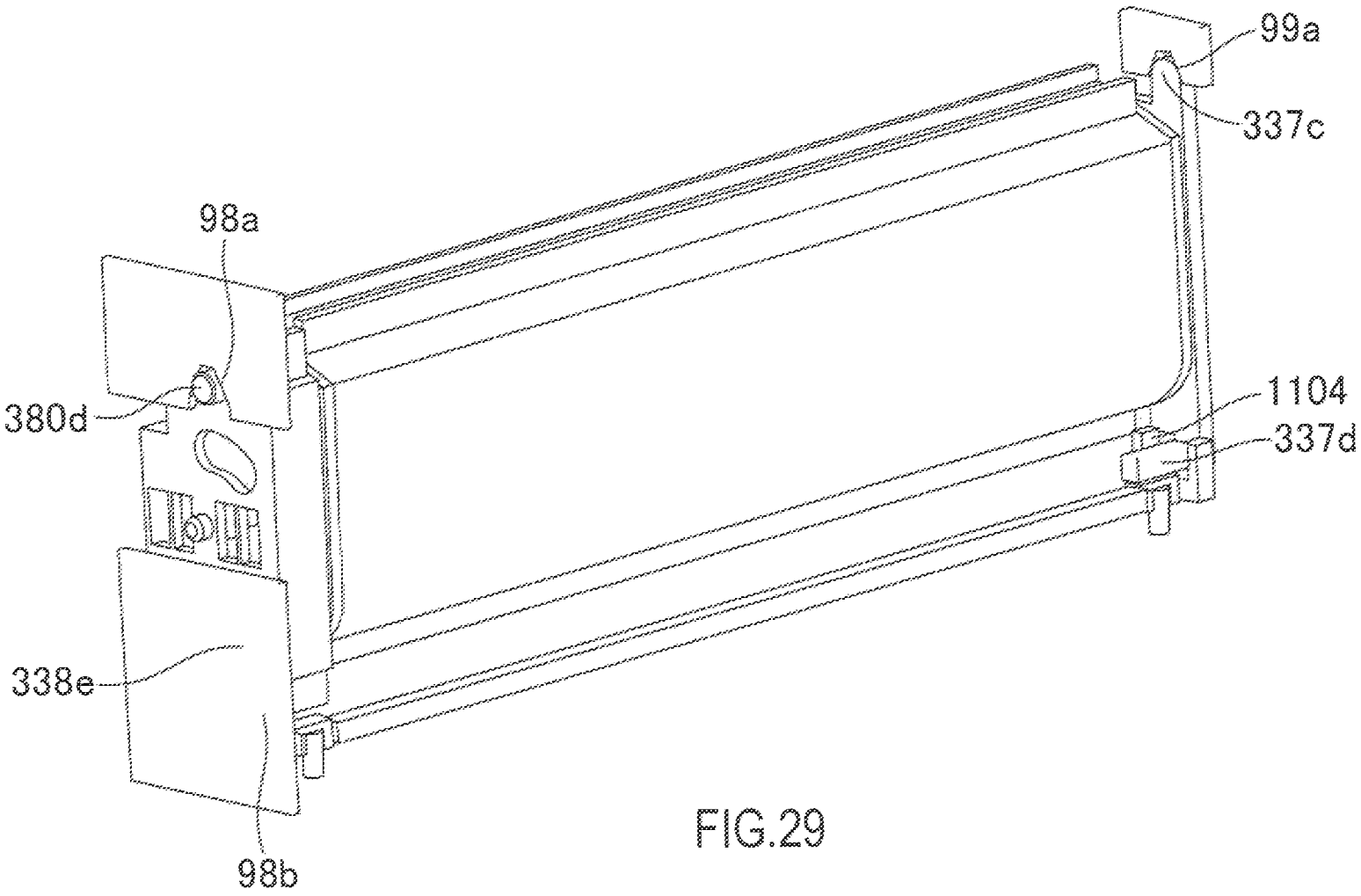
FIG. 29 is a view showing a state in which the developing cartridge according to the fourth embodiment has been attached to an apparatus main body.

Here, FIG. 27C is a view showing a state in which the developing cartridge 4 has been positioned with respect to the apparatus main body of the image forming apparatus 100. Further, in conjunction with the operation of closing the front cover 110 of the image forming apparatus 100, the first lower guide 104 having the back-side pressing member 106, the front-side pressing member 107, a main-body pressing spring 108, and a main-body pressing spring 109 moves upward. According to the operation, a back-side positioning portion 380*d* (corresponding to the other-end side positioned portion) of the back-side end member 38 comes in contact with an abutted portion 98*a* (corresponding to the other-end side positioning portion) of the back-side plate 98 (FIG. 29). In addition, a front-side positioning portion 337*c* (corresponding to a one-end side positioned portion) of the front-side end member 37 comes in contact with an abutted portion 99*a* (corresponding to a one-end side positioning portion) of a front-side plate 99. Thus, the developing cartridge 4 is positioned with respect to the apparatus main body of the image forming apparatus 100.

In addition, as shown in FIG. 29, the back-side end member 38 is provided with a boss 338*e* (corresponding to the other-end side rotation stop) that controls or restricts the rotation of the back-side end member 38. In a state in which the developing cartridge 4 has been attached to the apparatus main body of the image forming apparatus 100, the boss 338*e* of the back-side end member 38 fits into a rotation stop hole portion 98*b* of the back-side plate 98. Thus, the back-side end member 38 may be prevented from rotating inside the image forming apparatus 100.

Similarly, the front-side end member 37 is provided with a rotation stop 337*d* that controls or restricts the rotation of the front-side end member 37. In a state in which the developing cartridge 4 has been attached to the apparatus main body of the image forming apparatus 100, the rotation stop 337*d* (corresponding to a one-end side rotation stop) of the front-side end member 37 fits into a main-body rotation stop portion 1104 provided on the first lower guide 104. Thus, the front-side end member 37 may be prevented from rotating inside the image forming apparatus 100.

As described above, in the embodiment, in a state in which the developing cartridge 4 has been completely attached to the apparatus main body of the image forming apparatus 100, the back-side end member 38 and the front-side end member 37 are fixed to the apparatus main body of the image forming apparatus 100. On the other hand, in a state in which the developing cartridge 4 has been completely attached to the apparatus main body of the image forming apparatus 100, the developing frame body 31 is made to be rotatable with respect to the back-side end member 38 when the engagement between the groove portion 338*b* and the restricting member 340 is cancelled. Therefore, the developing frame body 31 is made to be rotatable inside the image forming apparatus 100, and the developing roller 25 and the photosensitive drum 1 are made to be capable of coming in contact with each other and separating from each other.

On the other hand, when the developing cartridge 4 is being inserted in the apparatus main body of the image forming apparatus 100, the rotation of the developing frame body 31 with respect to the back-side end member 38 may be restricted by the restricting member 340. Thus, the rotation of the developing frame body 31 is restricted when the developing cartridge 4 is being inserted in the apparatus main body of the image forming apparatus 100. In addition, as described above, when the developing cartridge 4 is being inserted in the apparatus main body of the image forming apparatus 100, the back-side end member 38 is positioned in the direction orthogonal to the direction in which the developing cartridge 4 is inserted. Thus, the rotation of the developing frame body 31 with respect to the apparatus main body of the image forming apparatus 100 is prevented, and the contact between the developing roller 25 and the photosensitive drum 1 is prevented. When the developing cartridge 4 is being in the apparatus main body of the image forming apparatus 100, it is possible to reduce the rattling of the developing cartridge 4 and prevent the developing roller 25 and the photosensitive drum 1 from contacting each other.

Note that in the embodiment, only the rotation of the back-side end member 38 with respect to the developing frame body 31 is restricted by the restricting member 340. However, the configuration is not necessarily limited to the above one. For example, the rotation of the front-side end member 37 with respect to the developing frame body 31 may also be restricted by the restricting member 340.

In the embodiment, the various guide ribs are configured to protrude in a direction orthogonal to the arrangement direction of the plurality of process cartridges, and the configurations of controlling or restricting the rotation according to the embodiment are arranged at positions included in the developing cartridges when projected in the direction orthogonal to the arrangement direction. That is, since the configurations of controlling or restricting the rotation are not configured to protrude in the arrangement direction, a design in the arrangement of the plurality of process cartridges is not hindered. Accordingly, in an inline system image forming apparatus, it is possible to minimize the interval between adjacent process cartridges and realize the above rotation control while avoiding the upsize of the apparatus.

As described above, according to an embodiment of the present invention, it is possible to prevent the upsize of a developing cartridge serving as a developing apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2016-038460, filed Feb. 29, 2016, No. 2016-057397, filed Mar. 22, 2016, No. 2017-025935, filed Feb. 15, 2017, and No. 2017-026341, filed Feb. 15, 2017 which are hereby incorporated by reference herein in their entirety.

What is claimed is:

1. A developing apparatus attachable and detachable relative to an apparatus main body of an image forming apparatus, the developing apparatus comprising:

a developer bearing member;

a developing frame that rotatably supports the developer bearing member;

a one-end side end member that is attached to one end of the developing frame in an axis direction of the developer bearing member, the one-end side end member comprising a one-end side positioned portion to be positioned with respect to the apparatus main body; and an other-end side end member that is attached to an other end of the developing frame in the axis direction of the developer bearing member, the other-end side end member comprising an other-end side positioned portion to be positioned with respect to the apparatus main body, wherein the one-end side end member is rotatable with respect to the developing frame and the other-end side end member, and the other-end side end member is rotatable with respect to the developing frame and the one-end side end member.

2. The developing apparatus according to claim 1, wherein the developing frame comprises a one-end side engaging portion that engages with the one-end side end member, and an other-end side engaging portion that engages with the other-end side end member, and wherein the one-end side end member and the other-end side end member are rotatable about a line that connects the one-end side engaging portion and the other-end side engaging portion to each other.

3. The developing apparatus according to claim 2, further comprising:

a preventing member that prevents the one-end side end member and the other-end side end member from coming off the one-end side engaging portion and the other-end side engaging portion, respectively.

4. The developing apparatus according to claim 1, wherein the one-end side positioned portion is a projection that is projected toward a direction crossing to the axis direction, and the other-end side positioned portion is a projection that is projected in the axis direction.

5. The developing apparatus according to claim 4, wherein the other-end side end member is disposed in a downstream side of the one-end side end member in an inserting direction in which the developing apparatus is inserted in the apparatus main body, and wherein the other-end side end member comprises a first guided portion to be guided by a first guide portion of the apparatus main body and a second guided portion to be guided by a second guide portion of the apparatus main body.

6. The developing apparatus according to claim 5, wherein the one-end side end member comprises a third guided portion to be guided by the first guide portion and a fourth guided portion to be guided by the second guide portion.

7. The developing apparatus according to claim 1, wherein the other-end side end member is disposed in a downstream side of the one-end side end member in an inserting direction in which the developing apparatus is inserted in the apparatus main body, and wherein the other-end side end member comprises an other-end side guided portion to be guided by a guide portion of the apparatus main body.

8. The developing apparatus according to claim 7, wherein the one-end side end member comprises a one-end side guided portion to be guided by the guide portion.

9. The developing apparatus according to claim 1, wherein the apparatus main body comprises an image bearing member on which a latent image is to be formed, and wherein the developing frame is rotatable to a position at which the developer bearing member and the image bearing member separate from each other and a position at which the developer bearing member and the image bearing member come into contact with each other.

10. The developing apparatus according to claim 9, further comprising:

an other-end side restricting member that restricts rotation of the other-end side end member;

an other-end side restricted portion capable of engaging with the other-end side restricting member;

a one-end side restricting member that restricts rotation of the one-end side end member; and a one-end side restricted portion capable of engaging with the one-end side restricting member, wherein the other-end side restricting member is movable to a position at which the other-end side restricting member engages with the other-end side restricted portion to restrict the rotation of the other-end side end member and a position at which the other-end side restricting member disengages from the other-end side restricted portion to allow the rotation of the other-end side end member, and wherein the one-end side restricting member is movable to a position at which the one-end side restricting member engages with the one-end side restricted portion to restrict the rotation of the one-end side end member and a position at which the one-end side restricting member disengages from the one-end side restricted portion to allow the rotation of the one-end side end member.

11. The developing apparatus according to claim 1, further comprising:

an other-end side restricting member that restricts rotation of the other-end side end member; and an other-end side restricted portion capable of engaging with the other-end side restricting member, wherein the other-end side restricting member is movable to a position at which the other-end side restricting member engages with the other-end side restricted portion to restrict the rotation of the other-end side end member and a position at which the other-end side restricting member disengages from the other-end side restricted portion to allow the rotation of the other-end side end member.

12. The developing apparatus according to claim 11, further comprising:

an other-end side urging member that urges the other-end side restricting member.

13. The developing apparatus according to claim 11, wherein the other-end side restricting member is provided on the developing frame, and the other-end side restricted portion is provided on the other-end side end member.

14. The developing apparatus according to claim 11, further comprising:

a one-end side restricting member that restricts rotation of the one-end side end member; and a one-end side restricted portion capable of engaging with the one-end side restricting member, wherein the one-end side restricting member is movable to a position at which the one-end side restricting member engages with the one-end side restricted portion to restrict the rotation of the one-end side end member and a position at which the one-end side restricting member disengages from the one-end side restricted portion to allow the rotation of the one-end side end member.

15. The developing apparatus according to claim 14, further comprising:

a one-end side urging member that urges the one-end side restricting member.

16. An image forming apparatus comprising:

the developing apparatus according to claim 1; and a photosensitive apparatus having an image bearing member that the developer bearing member comes in contact with and separates from, wherein the developing apparatus and the photosensitive apparatus are separately attachable and detachable to and from an apparatus main body of the image forming apparatus.

17. A developing apparatus comprising:

a developer bearing member;

a developing frame for rotatably supporting the developer bearing member, the developing frame including a first portion and a second portion, wherein in an axis direction of the developer bearing member, the first portion is disposed in a first end and the second portion is disposed in a second end opposite to the first end;

a first end member attached to the first portion; and a second end member attached to the second portion, and the second end member provided with a first opening and a second opening, wherein the first end member is rotatable with respect to the developing frame and the second end member, and the second end member is rotatable with respect to the developing frame and the first end member, and wherein as seen in the axis direction, the first end member partially overlaps the developing frame, the second end member partly overlaps the developing frame, and a part of the developing frame is exposed through the first opening and the second opening.

18. A developing apparatus attachable and detachable to and from an apparatus main body of an image forming apparatus, the developing apparatus comprising:

a developer bearing member;

a developing frame that rotatably supports the developer bearing member;

an end member that is attached to either one of a one-end side and an other-end side of the developing frame in an axis direction of the developer bearing member, the end member being rotatable with respect to the developing frame, and the end member comprising a positioned portion to be positioned with respect to the apparatus main body;

a restricting member that restricts rotation of the end member; and a restricted portion capable of engaging with the restricting member, wherein the restricting member is movable to a position at which the restricting member engages with the restricted portion to restrict the rotation of the end member and a position at which the restricting member disengages from the restricted portion to allow the rotation of the end member.

19. The developing apparatus according to claim 18, wherein the restricting member is provided on the developing frame, and the restricted portion is provided on the end member.

20. The developing apparatus according to claim 19, wherein the developing apparatus is attachable and detachable to and from an apparatus main body of an image forming apparatus along the axis direction of the developer bearing member, wherein the restricting member is movable in a direction in which the developing apparatus is inserted in the apparatus main body, and wherein the restricted portion is a groove portion into which the restricting member fits from the direction in which the developing apparatus is inserted in the apparatus main body.

21. The developing apparatus according to claim 20, further comprising:

an urging member that urges the restricting member toward a direction in which the restricting member and the restricted portion engage with each other.

22. The developing apparatus according to claim 21, wherein the restricting member is pressed in a direction opposite to the direction in which the developing apparatus is inserted in the apparatus main body by an engagement cancelling portion provided on the apparatus main body, to cancel engagement between the restricting member and the restricted portion.

23. The developing apparatus according to claim 18, wherein the end member is positioned with respect to an apparatus main body in a state in which the developing apparatus is attached to the apparatus main body, and wherein the developer bearing member comes in contact with and separates from an image bearing member when the developing frame rotates with respect to the end member.

24. An image forming apparatus comprising:

the developing apparatus according to claim 1; and an image bearing member that comes in contact with and separates from the developer bearing member, wherein the image forming apparatus forms an image on a recording medium using a developer image formed on the image bearing member by the developing apparatus.

25. The developing apparatus according to claim 17, wherein the developing frame is rotatable with respect to the first end member and the second end member, so that the developer bearing member is movable between a position at which the developer bearing member contacts an image bearing member to develop a latent image formed on the image bearing member, and a position at which the developer bearing member is separated from the image bearing member.

26. The developing apparatus according to claim 25, wherein the first portion comprises a first engaging portion that engages a first hole provided on the first end member, and the second portion comprises a second engaging portion that engages a second hole provided on the second end member, and wherein the first end member and the second end member are rotatable about a line that connects the first engaging portion and the second engaging portion to each other.

27. The developing apparatus according to claim 26, further comprising:

a first preventing member attached to the first engaging portion, the first preventing member preventing the first end member from coming off the first engaging portion; and a second preventing member attached to the second engaging portion, the second preventing member preventing the second end member from coming off the second engaging portion.

28. The developing apparatus according to claim 25, wherein the developing apparatus is attachable and detachable to and from an apparatus main body of the image forming apparatus in the axis direction.

29. The developing apparatus according to claim 28, wherein in an inserting direction of the developing apparatus, the second end member is disposed in a downstream side of the first end member.

30. The developing apparatus according to claim 28, wherein the image bearing member is provided in an image bearing unit attachable and detachable relative to the apparatus main body, and wherein the developing apparatus and the image bearing unit are attachable and detachable relative to the apparatus main body, independently from each other.

31. The developing apparatus according to claim 17, further comprising:

a restricting member that restricts rotation of the second end member, the restricting member being movable between a position to restrict the rotation of the second end member and a position to allow the rotation of the second end member.

32. The developing apparatus according to claim 31, further comprising:

an urging member that urges the restricting member to the position to restrict the rotation of the second end member from the position to allow the rotation of the second end member.

33. The developing apparatus according to claim 17, further comprising:

a first restricting member that restricts rotation of the first end member, the first restricting member being movable to a position to restrict the rotation of the first end member and a position to allow the rotation of the first end member, and a second restricting member that restricts rotation of the second end member, the second restricting member being movable to a position to restrict the rotation of the second end member and a position to allow the rotation of the second end member.

34. The developing apparatus according to claim 33, further comprising:

a first urging member that urges the first restricting member to the position to restrict the rotation of the first end member from the position to allow the rotation of the first end member, and a second urging member that urges the second restricting member to the position to restrict the rotation of the second end member from the position to allow the rotation of the second end member.

* * * * *